US010648196B2

(12) United States Patent
Neau et al.

(10) Patent No.: US 10,648,196 B2
(45) Date of Patent: May 12, 2020

(54) LOCKBOX WITH MULTI-POSITION SHACKLE

(71) Applicant: The Master Lock Company LLC, Oak Creek, WI (US)

(72) Inventors: Michael Neau, Kenosha, WI (US); Glen Walter Brown, Mundelein, IL (US); Lea Marie Plato, Shorewood, WI (US)

(73) Assignee: MASTER LOCK COMPANY LLC, Oak Creek, WI (US)

( * ) Notice: Subject to any disclaimer, the term of this patent is extended or adjusted under 35 U.S.C. 154(b) by 178 days.

(21) Appl. No.: 15/884,521

(22) Filed: Jan. 31, 2018

(65) Prior Publication Data

US 2019/0234113 A1 Aug. 1, 2019

(51) Int. Cl.
*E05B 19/00* (2006.01)
*E05B 67/06* (2006.01)
(Continued)

(52) U.S. Cl.
CPC ..... *E05B 19/0005* (2013.01); *E05B 17/002* (2013.01); *E05B 65/0075* (2013.01);
(Continued)

(58) Field of Classification Search
CPC .... E05B 19/0005; E05B 35/086; E05B 67/00; E05B 67/02; E05B 67/06; E05B 67/063; E05B 67/22; E05B 67/38; E05B 67/383
See application file for complete search history.

(56) References Cited

U.S. PATENT DOCUMENTS 1,842,559 A 2/1929 Murphy
4,290,279 A * 9/1981 Fish ..... E05B 67/24 70/367
(Continued)

FOREIGN PATENT DOCUMENTS

CA 2783204 A1 12/2008
WO 2011/053949 A1 5/2011

OTHER PUBLICATIONS

International Search Report and Written Opinion for PCT/US2017/017148 dated May 4, 2017.

*Primary Examiner* — Christopher J Boswell
(74) *Attorney, Agent, or Firm* — Calfee, Halter & Griswold LLP

(57) ABSTRACT

A lock assembly includes a lock body and a U-shaped shackle having a curved portion extending between first and second legs receivable in first and second shackle apertures in an upper portion of the lockbox body. The shackle has a guard wall affixed to an interior surface of the curved portion, the guard wall defining an interior arcuate wall surface extending forward and rearward from a central plane bisecting the shackle. The upper portion of the lock body includes first and second protruding projections at least partially surrounding the first and second shackle apertures and defining first and second upwardly diverging interior surfaces laterally aligned with the curved portion of the shackle. The lock body includes a latching mechanism configured to secure the shackle in a plurality of latched positions to adjust a distance between the first and second upwardly diverging interior surfaces and the curved portion of the shackle. When the shackle is secured around a door handle with the shackle secured in a suitable one of the plurality of latched positions, abutment of the interior arcuate wall surface with a neck portion of the door handle impedes forward and rearward rotation of the lock assembly
(Continued)

about a horizontal axis extending through the curved portion of the shackle and abutment of the first and second upwardly diverging interior surfaces with a neck portion of the door handle impedes side-to-side twisting rotation of the lock assembly about a vertical axis extending through the curved portion of the shackle.

19 Claims, 30 Drawing Sheets

(51) Int. Cl.

| | |
|---|---|
| ***E05B 65/00*** | (2006.01) |
| ***E05B 17/00*** | (2006.01) |
| ***E05B 67/02*** | (2006.01) |
| ***E05B 67/38*** | (2006.01) |
| ***E05G 1/00*** | (2006.01) |
| ***E05G 1/026*** | (2006.01) |
| ***E05B 67/22*** | (2006.01) |
| *E05B 37/02* | (2006.01) |

(52) U.S. Cl.

CPC ..... *E05B 67/02* (2013.01); *E05B 67/063* (2013.01); *E05B 67/22* (2013.01); *E05B 67/38* (2013.01); *E05B 67/383* (2013.01); *E05G 1/005* (2013.01); *E05G 1/026* (2013.01); *E05B 37/025* (2013.01)

(56) References Cited

U.S. PATENT DOCUMENTS

| | | | | |
|---|---|---|---|---|
| 4,532,783 | A * | 8/1985 | Maurice | E05B 19/0005 70/162 |
| 4,641,505 | A * | 2/1987 | Maurice | E05B 19/0005 70/162 |
| 4,901,543 | A | 2/1990 | Appelbaum | |
| 4,982,586 | A | 1/1991 | Wingert | |
| 5,216,903 | A * | 6/1993 | Chen | E05B 67/38 70/417 |
| 5,303,568 | A * | 4/1994 | Wightman | E05B 67/38 70/455 |
| 5,931,030 | A | 8/1999 | Chen | |
| 6,393,876 | B1 * | 5/2002 | Matyko | E05B 67/02 70/38 A |
| 6,718,802 | B2 * | 4/2004 | Vito | B62H 5/00 70/18 |
| 6,845,519 | B2 | 1/2005 | Garneau | |
| 7,380,425 | B2 * | 6/2008 | Elliott | E05B 67/02 70/38 R |
| 9,540,845 | B1 * | 1/2017 | Yang | E05B 19/0005 |
| 10,221,590 | B2 * | 3/2019 | Sanford | E05B 17/10 |
| 2007/0091583 | A1 | 4/2007 | Dial | |
| 2011/0056251 | A1 * | 3/2011 | Komiya | E05B 19/0005 70/52 |
| 2011/0079056 | A1 | 4/2011 | Sakai | |
| 2014/0373578 | A1 * | 12/2014 | Chang | E05B 19/0005 70/21 |
| 2017/0234038 | A1 | 8/2017 | Sanford | |

* cited by examiner

10

10

10

10

10

10

10

10

LOCKBOX WITH MULTI-POSITION SHACKLE

BACKGROUND

Devices for retaining a key at a site, such as lockboxes, are known in the art to provide a means for multiple salesmen to gain access to a locked building. These devices have various drawbacks. For example, the lockbox may be tampered with and forcibly removed from the door handle, particularly by a tool such as a crowbar. Additionally, as lockboxes are meant to be unitary and prevent breakage, traditional lockboxes only accommodate a single sized door handle. As door handles come in a variety of sizes and shapes, traditional lockboxes do not securely fit on all door handles. Further, as most lockboxes are constructed of metal, the lockboxes may scratch or mar the door handles, especially when the lockbox is not securely or properly fitted to the door handle.

SUMMARY

The present invention contemplates and generally discloses an inventive lock assembly. In one embodiment, a lock assembly is disclosed that is securable in a plurality of latched positions and maintains a secure fit on a plurality of door handles without scratching or marring the door hardware. Embodiments of the lock assembly may be used in a variety of applications to provide multiple users access to a house or building. For example, the lock assembly may be attached to a door handle, gas meter, or grate to provide multiple realtors with the proper combination to access a home or building for sale. The lock assembly may be adapted to be placed and secured on a variety of objects such that a user may enter the correct unlocking combination to remove an item, such as a key, from the internal cavity of the lock assembly while the lock assembly is still attached to the object.

According to one inventive aspect of the present application, a lock assembly may be provided to be securely fastened around door handles or similar objects of varying sizes and geometries. In one embodiment, the lock assembly includes a lock body and shackle with a generally U-shaped shackle member and a guard wall affixed to an interior surface of the curved portion and defining an interior arcuate wall surface extending forward and rearward from a central plane bisecting the shackle. The lock body includes a latching mechanism configured to secure the shackle in a plurality of latched positions to adjust a distance between the upper surface of the lock body and the interior arcuate wall surface. When the shackle is secured around a door handle with the shackle secured in a suitable one of the plurality of latched positions, abutment of the interior arcuate wall surface with a neck portion of the door handle impedes forward and rearward rotation of the lock assembly about a horizontal axis extending through the curved portion of the shackle.

According to another inventive aspect of the present application, a lock assembly may be provided which prevents being rotated off a door handle, particularly a lever-set handle, when the lockbox assembly is secured around the door handle. In one embodiment, the lock assembly includes a lock body and a U-shaped shackle having a curved portion extending between first and second legs receivable in first and second shackle apertures in an upper portion of the lock body. The upper portion of the lock body includes first and second protruding projections at least partially surrounding the first and second shackle apertures and defining first and second upwardly diverging interior surfaces laterally aligned with the curved portion of the shackle. The lock body includes a latching mechanism configured to secure the shackle in a plurality of latched positions to adjust a distance between the first and second upwardly diverging interior surfaces and the curved portion of the shackle. When the shackle is secured around a door handle with the shackle secured in a suitable one of the plurality of latched positions, abutment of the first and second upwardly diverging interior surfaces with a neck portion of the door handle impedes side-to-side twisting rotation of the lock assembly about a vertical axis extending through the curved portion of the shackle.

According to another inventive aspect of the present application, a lockbox assembly may be provided with a lockbox body and a shackle which may be locked together at a plurality of latched positions which may be adjusted when the interior of the lockbox body is exposed. In one embodiment, the lockbox assembly includes a lockbox body defining an interior cavity for storing an item, a door lockingly secured with the lockbox body to block access to the interior cavity, and a U-shaped shackle having a curved portion extending between first and second legs receivable in first and second shackle apertures in an upper portion of the lockbox body. A latching mechanism is disposed in the lockbox body and configured to secure the shackle in a plurality of latched positions to adjust a distance between the upper portion of the lockbox and the curved portion of the shackle. The latching mechanism includes a latch member spring biased into interlocking engagement with an aligned one of a plurality of latch points on at least one of the first and second shackle legs, and a release button disposed in the interior cavity and depressible to disengage the latch member from the aligned one of the plurality of latch points for adjustment of the shackle to a selected position aligning another one of the plurality of latch points with the latch member.

There are numerous embodiments of the methods and devices described herein, all of which are intended to be non-limiting examples. Additional features and advantages of the invention will be set forth in part in the description which follows, and in part will be obvious from the description, or may be learned by practice of the invention. The invention is far broader than the descriptions of the specific embodiments below.

DETAILED DESCRIPTION

Figure 1A:
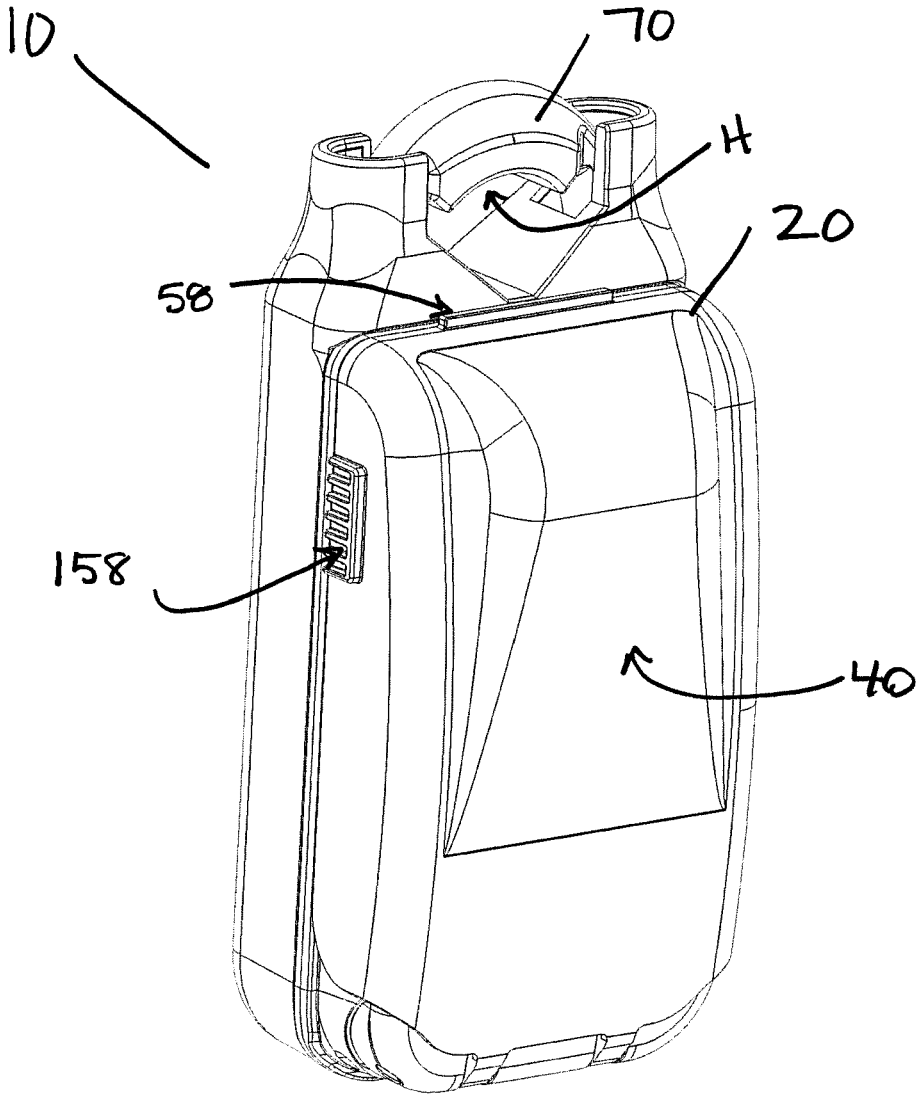
FIGS. 1A-1C are perspective views of a lockbox assembly, in accordance with an exemplary embodiment of the present application.

The present invention provides a lockbox assembly that maintains a lockbox securely in place on door handles of varying sizes and shapes without scratching or marring the door hardware. According to one aspect of the present application, a lockbox assembly may be provided with a shackle that is lockable within the lockbox body at a plurality of latching or latched positions. According to another aspect of the present application, a lockbox assembly may include a shackle with a guard wall defining an interior arcuate wall surface which provides greater contact with the neck of a door handle to prevent the forcible removal of the lockbox assembly from the door handle by use of an object, such as a crowbar. According to a further aspect of the present application, a lockbox assembly may include a shackle with a molded-over cover and a casing with two protruding projections and defining a V-shaped notch to secure the shackle on varying sized door handles or other lockable objects and prevent scratching or marring of the locking surface.

An exemplary embodiment of the lockbox assembly 10 of the present invention is shown in detail in FIGS. 1A-3 and includes a lockbox body 20 and a shackle 70. The shackle 70 is generally U-shaped and may be placed around a portion of a door handle, such as the neck of the door handle, or a similar object and partially received in the lockbox body 20 to secure a fit around the object. In an exemplary embodiment, the shackle 70 may be locked in a plurality of positions within the lockbox body 20 and secure a fit around the door handle or similar object. Additionally, the lockbox body 20 may include an upper casing which provides a secure fit of the lockbox body on various sized and shaped door handles and prevents twisting of the body. Additionally or alternatively, the shackle 70 may include a guard wall which defines an interior arcuate wall surface to provide increased contact with the neck of a door handle and prevent the forcible removal of the lockbox.

The exemplary lockbox body 20 is generally a rectangular enclosure and has a rear wall 24, two side walls 26, an upper wall 28, a bottom wall 30, and a weather cover 40. A door 22 is lockingly secured with the remainder of the lockbox body 20 and may be operatively removed from the remainder of the body, either fully or partially. In an exemplary embodiment, the lockbox body 20 is tamper and weather resistant.

Figure 1B:
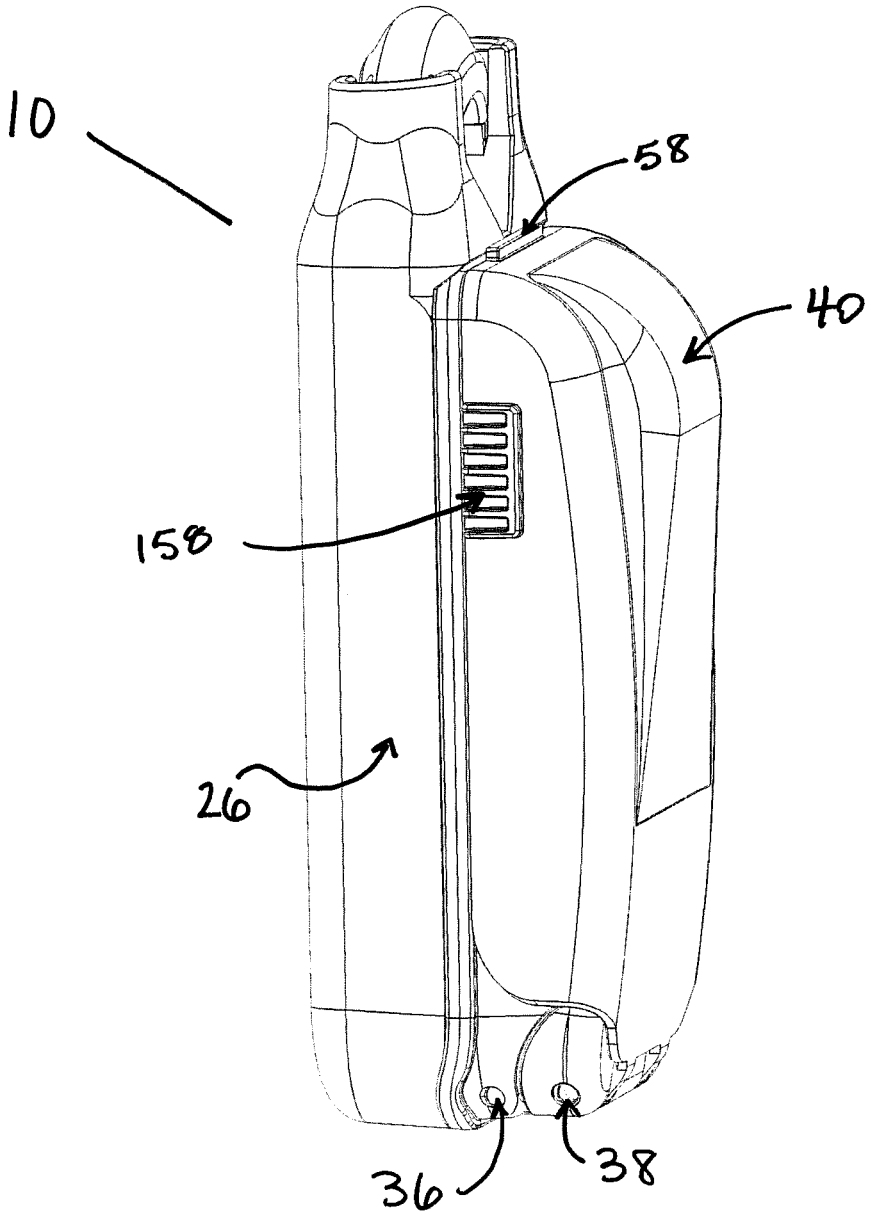

As shown in FIG. 1B, the exemplary lockbox body 20 has a door hinge 36 which connects the door 22 to the body 20 and allows for pivoting movement of the door 22 away from the rest of the body, and a weather cover hinge 38 which connects a weather cover 40 to the remainder of the body and allows for pivoting movement of the weather cover 40 away from the rest of the body. In an exemplary embodiment, the door hinge 36 and the weather cover hinge 38 are located at the bottom of the lockbox body 20. In a preferred embodiment, the door 22 and weather cover 40 are secured to the lockbox body 20 at the door hinge 36 and weather cover hinge 38, respectively, with a fastener, such as a screw or pin.

Figure 1C:
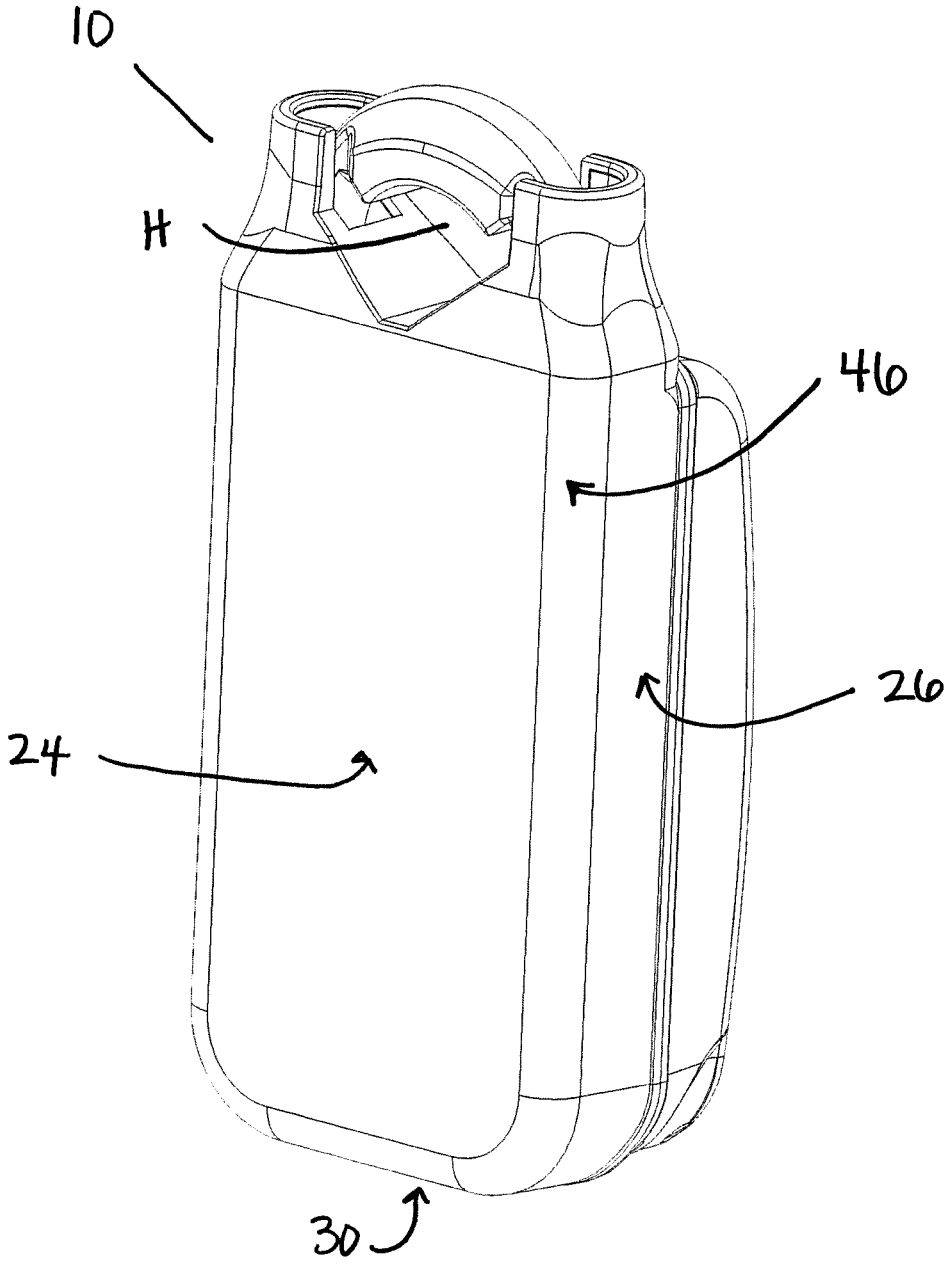
Figure 2:
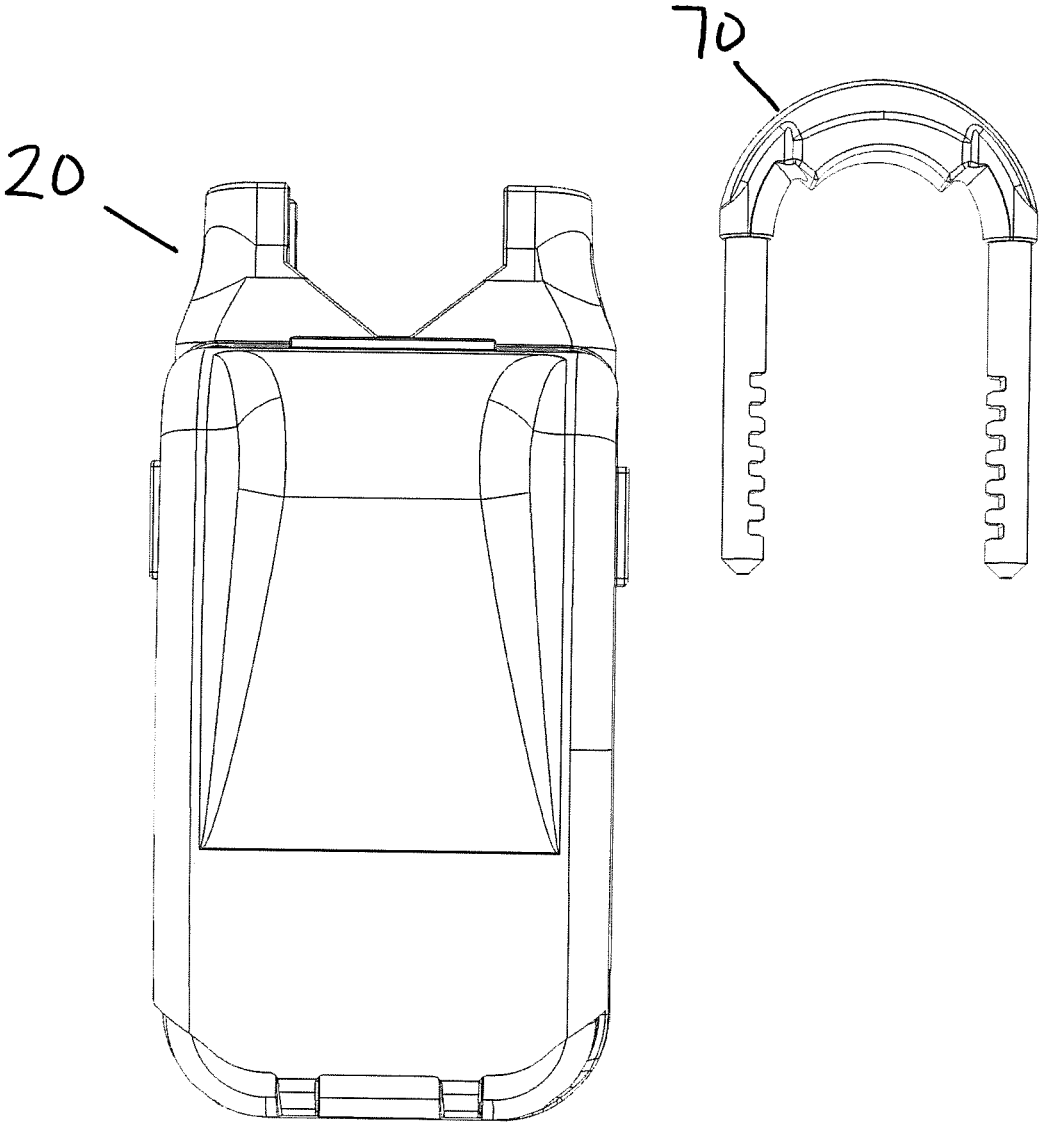
FIG. 2 is a front view of the lockbox assembly of FIGS. 1A-1C with the shackle removed from the lockbox body.

Optionally, as shown in FIG. 1C, the body 20 may also have a lower casing 46 which surrounds the rear wall 24 and at least a part of the side walls 26. In an exemplary embodiment, the lower casing 46 is made of plastic. As will be discussed below, when the lockbox assembly 10 is secured around a door handle or similar object, the lower casing 46 protects the lockbox and prevents the lockbox body from scratching or marring the door hardware. While the lower casing 46 has been described as being plastic and surrounding the rear wall 24 and at least part of the side walls 26, other embodiments are contemplated. For example, the lower casing 46 may surround all of side walls 26 or surround only the rear wall 24, or the lower casing 46 may be made of any other material known in the art.

Figure 4A:
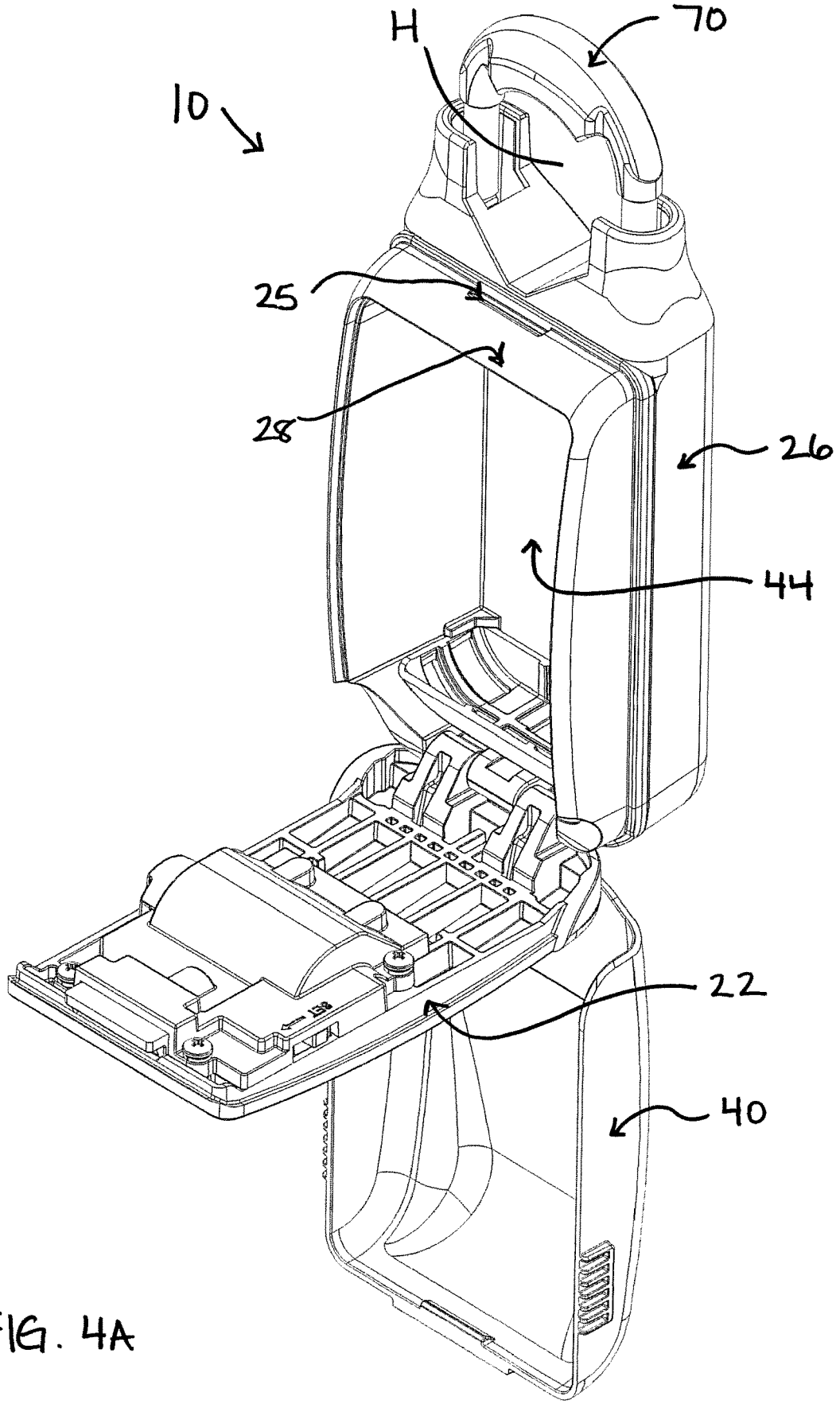
FIGS. 4A-4B are perspective views of the lockbox assembly of FIGS. 1A-1C with the door and weather cover pivoted away from the remainder of the lockbox body.
Figure 4B:
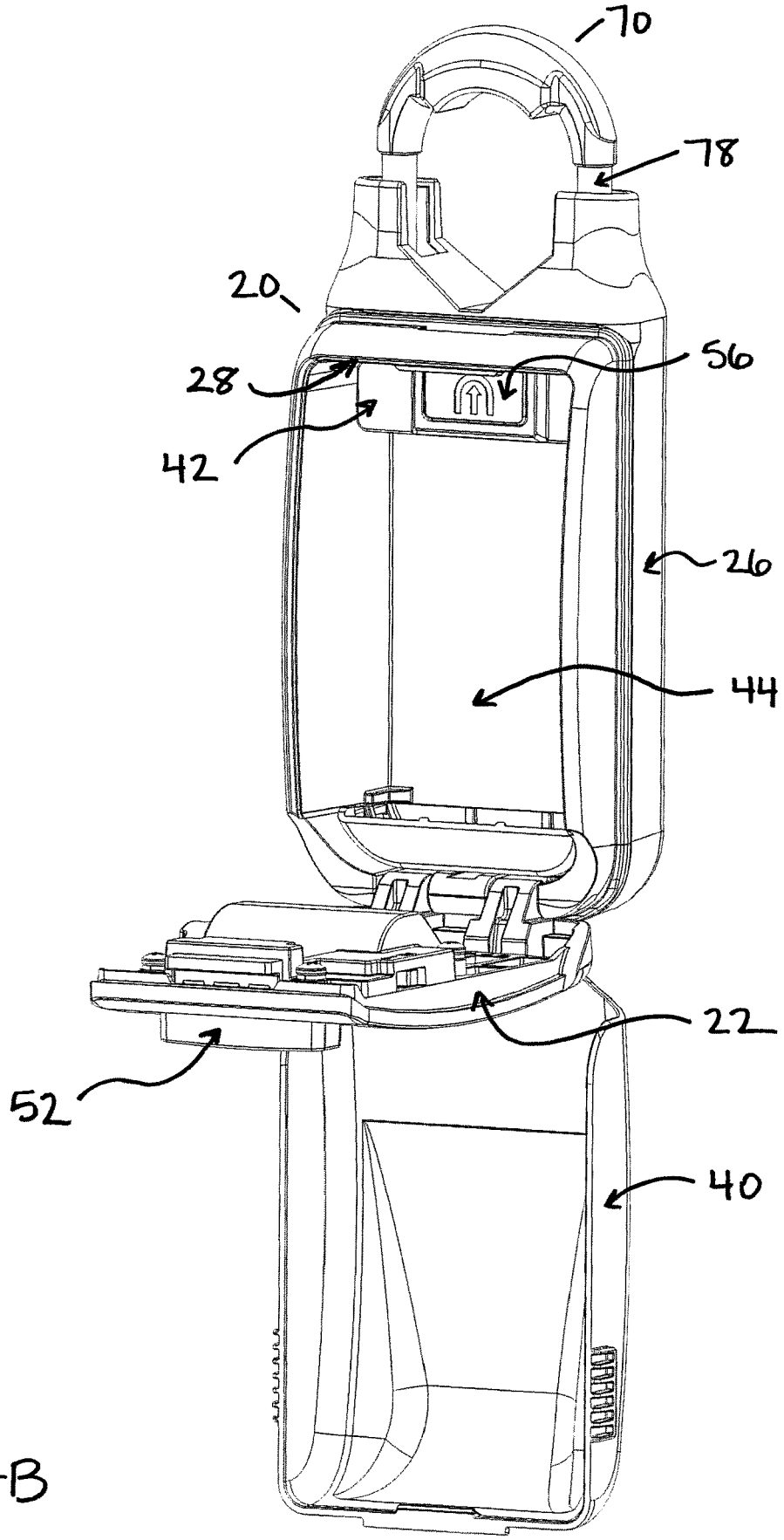

FIGS. 4A and 4B depict an exemplary interior of the lockbox body 20. The interior of the lockbox body 20 has a retaining body 42 which houses a latching mechanism to secure the shackle at a plurality of latching or latched positions and an interior compartment or cavity 44 for storing keys or other items. The interior cavity 44 has an opening disposed behind the door 22 and extending inwardly therefrom toward the rear wall 24. In an exemplary embodiment, the interior cavity 44 is rectangular and sized to store at least one key. In a preferred embodiment, the internal cavity extends substantially toward the rear wall 24 to a distance that maximizes the volume of the interior cavity 44 while still providing for a rear wall 24 that is thick enough to resist attack. Also disposed within the lockbox body 20 and beneath the door 22, the lockbox body 20 includes a release button 56 disposed on the retaining body 42 above the interior cavity 44.

Figure 5A:
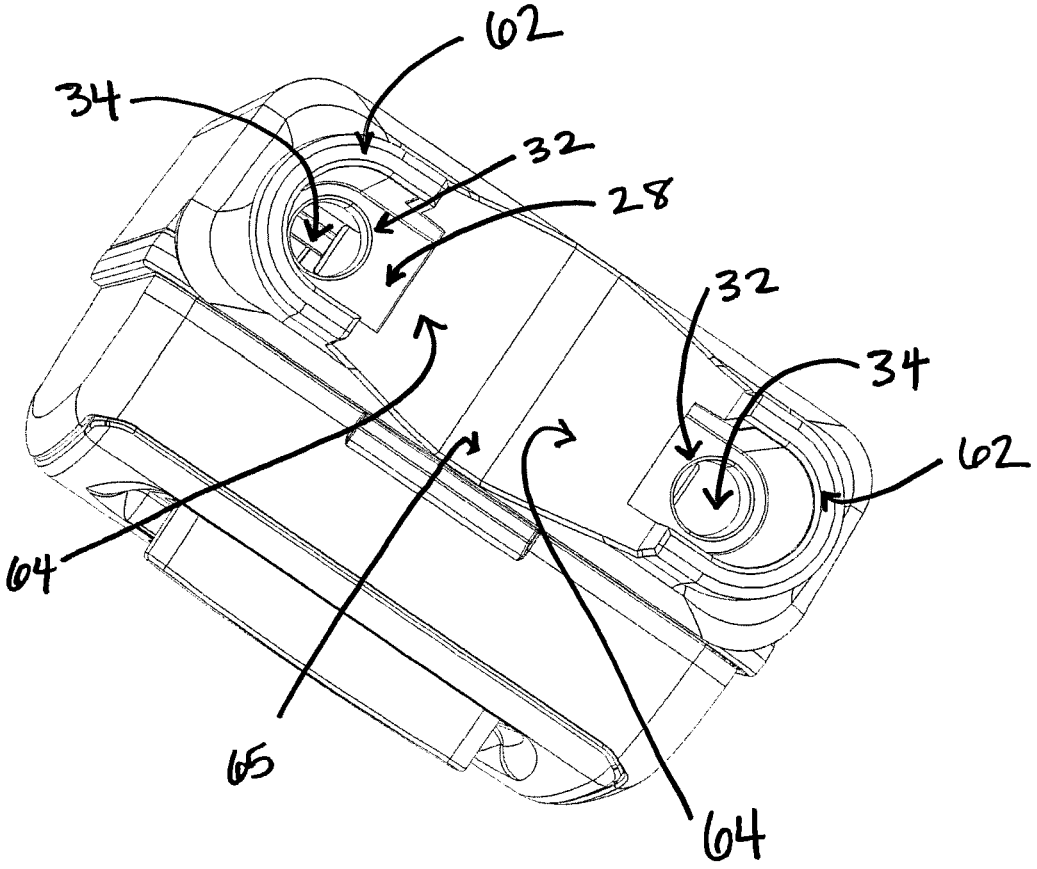
FIG. 5A is a top perspective view of the lockbox body of the lockbox assembly of FIGS. 1A-1C.
Figure 5B:
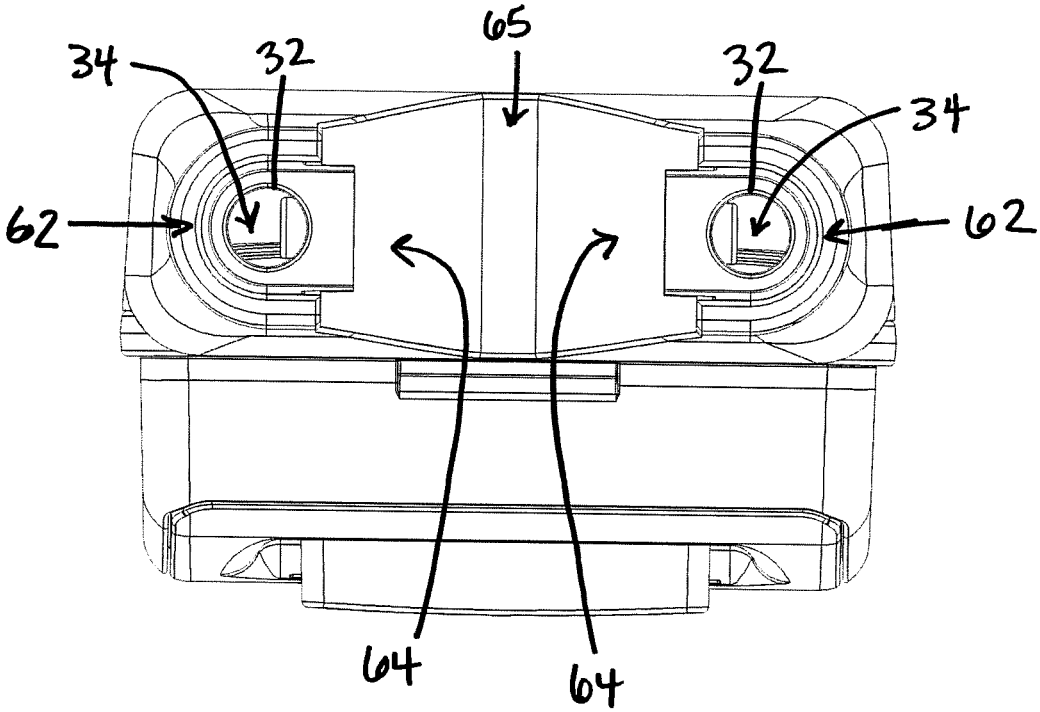
FIG. 5B is a top view of the lockbox body of the lockbox assembly of FIGS. 1A-1C.

The retaining body 42 is a generally rectangular hollow block disposed at a top portion of the interior of the body between the two side walls 26. In the depicted embodiment, the retaining body 42 is flush with the bottom surface of the lock body upper wall 28. However, it will be appreciated that there may be space between the bottom surface of the upper wall 28 and the retaining body 42. Internally, the retaining body 42 defines two shackle bores 34 and at least one side passage (not pictured) which extends into the shackle bores 34 (FIGS. 5A and 5B). The shackle bores 34 are substantially cylindrical, designed to receive a leg of the shackle 70, and extend through the retaining body 42 such that shackle legs may be retained in the retaining body 42 at a plurality of latched positions. The at least one side passage opens into the shackle bores 34 and allows a locking member to be received laterally into the shackle bore 34 to secure the shackle 70 at one of a plurality of latched positions, as will be discussed below. While the shackle bores 34 have been explained as cylinders, other embodiments are anticipated. For example, instead of a cylindrical bore, the retaining body 42 may have openings at its top and bottom and the interior of the retaining body 42 may be open such that a latch member may retain the shackle legs 78 in the openings.

Figure 8:
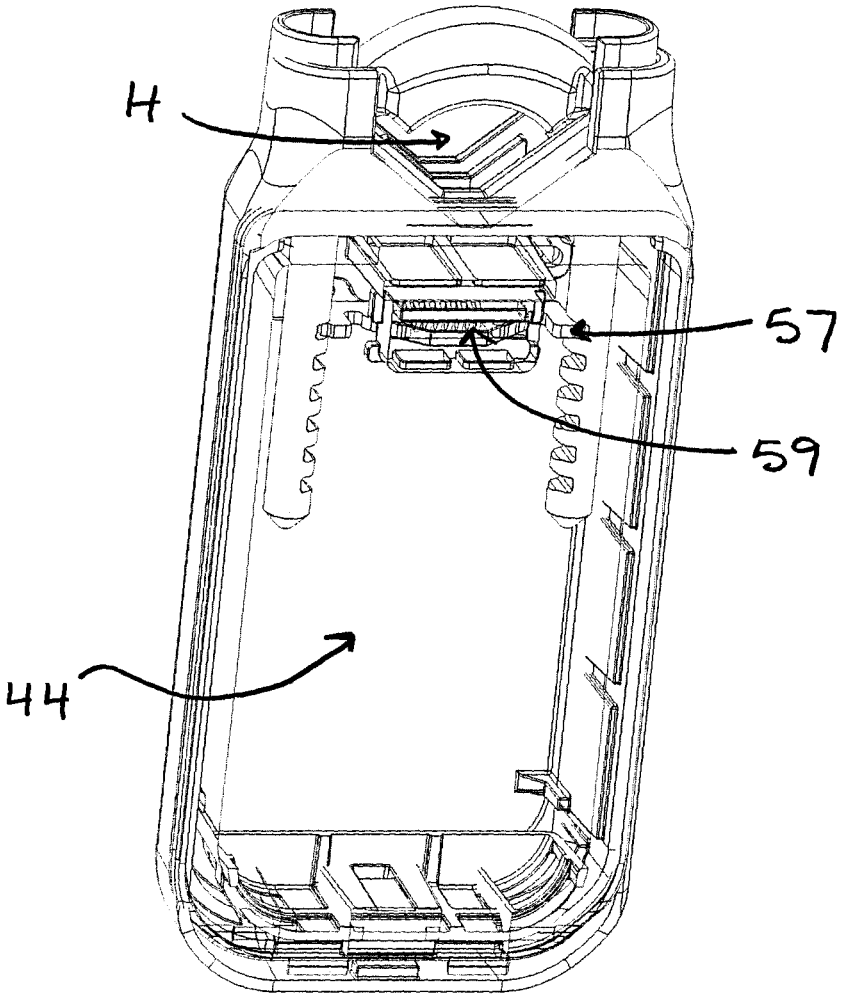
FIG. 8 is a top perspective view of the lockbox assembly of FIGS. 1A-1C with the front housing shell, door, weather cover, and latch retaining body removed to show the latching mechanism.

Turning to FIG. 8, the interior of the lockbox body 20 is shown with the front face of the retaining body 42 removed. The retaining body 42 includes a latching mechanism consisting of a latch member 57 and latch member spring 59 disposed within the retaining body and coupled to the release button 56 disposed on a front face of the retaining body 42. The latch member 57 is generally a rod or bar with cutouts or groves to connect to the latch member spring 59 and is substantially disposed within the at least one side passage and is laterally moveable within the at least one side passage. The distal ends of the latch member 57 are sized to be received in a latch point on the shackle 70. The latch member 57 may be two pieces or may be hinged or jointed such that both ends of the latch member 57 may be simultaneously extended into the latch points. The latch member spring 59 may be any type of spring known in the art and is disposed within the retaining body 42 such that, in an undisturbed state, the spring force biases the latch member 57 into a locking position wherein the latch member 57 extends laterally into the shackle bores 34. In a preferred embodiment, the latch member 57 and latch member spring 59 are metal and the latch member 57 is strong enough to retain the shackle 70 in the shackle bores 34 without breaking or sheering.

The release button 56 is moveable by a user between an undisturbed or extended position and a pressed or retracted position to operatively control the positioning of the latch member 57 and latch member spring 59. When the release button 56 is in the undisturbed position, the latch member spring 59 biases the latch member 57 laterally into both shackle bores 34. When the release button 56 is moved to the pressed or retracted position, the biasing force of the latch member spring 59 is removed and the latch member 57 is retracted from the shackle bores 34. As will be discussed below, the release button 56, latch member 57, and latch member spring 59 operatively secure or release the shackle 70 in the shackle bores 34.

Figure 3:
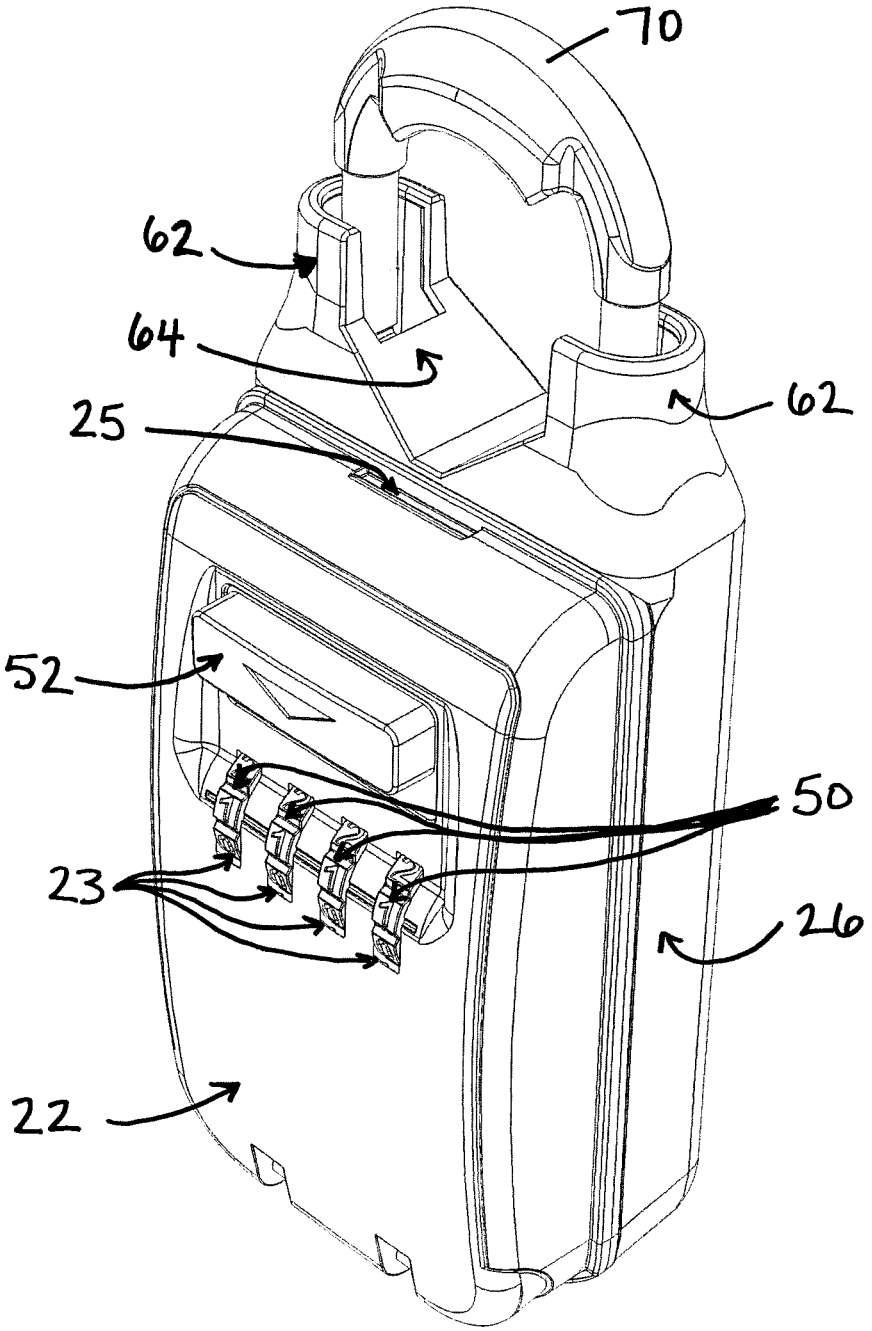
FIG. 3 is a perspective view of the lockbox assembly of FIGS. 1A-1C with the weather cover removed from the door.

Turning to FIGS. 3 and 4A, the door 22 is operatively connected to the body 20 and movable between a closed position (FIG. 3) blocking access to the cavity 44 and an open position (FIG. 4A) permitting access to the cavity 44. While the illustrated embodiment depicts the door 22 as pivotably connected with the lockbox body, the door may be slideable, removeable, or otherwise moveable between closed and open positions. Also, the door hinge 36 may be located at a position other than the bottom of the lockbox body 20 such as in a central region of both the door 22 and the remainder of the lockbox body 20. In such an embodiment, the door 22 would constitute a portion of a front face such that the door 22 could be opened to expose the interior of the lockbox body 20 without removing the entire front face of the body 20.

As shown in FIG. 3, the door 22 includes a lock interface. In the depicted embodiment, a plurality of combination dials 50 are carried by the door 22, with user graspable portions of the combination dials 50 protruding from or exposed through openings 23 in the door 22 for user rotation of the dials 50. While the illustrated dials include number markings, 0 through 9, to identify the rotational orientation of each dial, any types of markings may be used (including, for example, letters, symbols, pictures, or colors). The door 22 also includes an open lever 52 moveable between a first position which locks the door 22 to the lockbox body 20 and a second position which permits the door 22 to be removed from the lockbox body 20. However, as will be explained below, the door 22 may be provided with other types of lock interfaces. Additionally or alternatively, a lock interface may be provided on the lockbox body (not shown).

Referring to FIGS. 1A-3, in an exemplary embodiment, the weather cover 40 is attached to the body 20 and fitted to completely cover the door 22. The weather cover 40 is moveable between a closed position (FIGS. 1A-1C) covering the door 22 and lock interface (e.g., combination dials 50 and open lever 52) from the elements or user manipulation and an open position (FIG. 3) permitting access to the lock interface. In an exemplary embodiment, the weather cover 40 is made of a plastic and is rounded.

In an exemplary embodiment, the weather cover 40 has at least one weather cover latch 58 disposed on the top of the weather cover 40. The weather cover latch 58 is receivable in a weather cover latch receptacle 25 at the top of the door 22, and connects the weather cover 40 to the door 22. The weather cover latch 58 snap fits into the weather cover latch receptacle 25. In use, a user may snap the weather cover 40 closed by moving the weather cover latch 58 into the weather cover latch receptacle 25 and may open the weather cover 40 by removing the weather cover latch 58 from the weather cover latch receptacle 25 and pivoting the weather cover 40 away from the lockbox body 20. In the depicted embodiment, the weather cover 40 optionally includes two weather cover grips 158 which facilitate a user's securing and removing of the weather cover 40.

Referring back to FIG. 3, the lockbox body 20 includes a lock interface which a user can manipulate to unlock and open the door 22. Any number of user interfaces are contemplated such as push button, key lock, electronic, or combination. In the illustrated embodiment, the lock interface is a multiple combination dial lockbox, as mentioned above. One such multiple combination dial is described in U.S. patent application Ser. No. 15/428,484 to Sanford, filed Feb. 9, 2017, now published as U.S. Pub. No. 2017/0234038, the entire disclosure of which is incorporated herein by reference. Additionally, the combination can be resettable. When the lock interface has been properly manipulated (e.g., the correct combination entered on the dials), a user may move the open lever 52 to the second position and remove the door 22 from the remainder of the body 20.

Figure 5C:
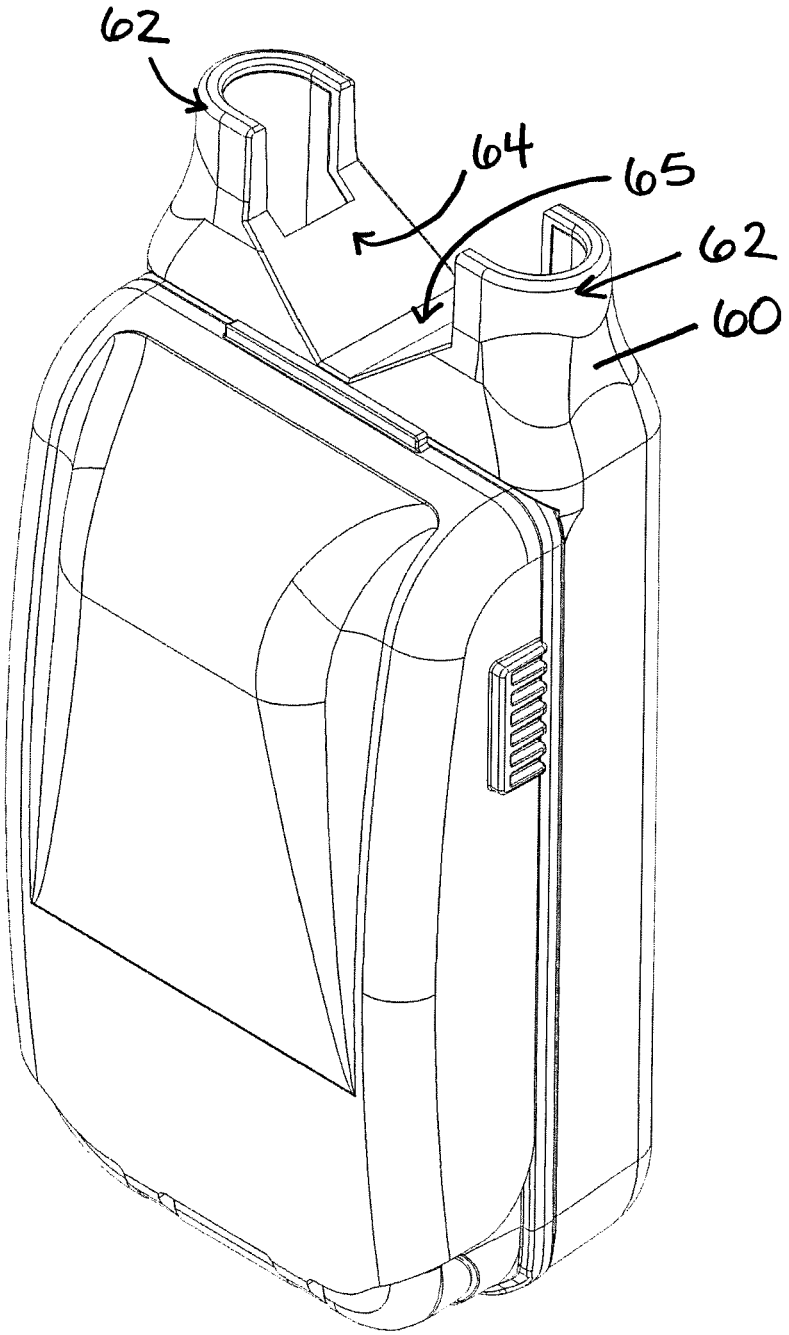
FIG. 5C is a top perspective view of the lockbox body of the lockbox assembly of FIGS. 1A-1C with the shackle removed.

Turning to FIG. 5, the upper wall 28 defines two shackle apertures 32 located on substantially opposite sides of the upper wall 28 near the side walls 26. The shackle apertures 32 are substantially above and congruent to the two shackle bores 34 and sized to receive legs of the shackle 70.

In an exemplary embodiment, the lockbox body 20 also has an upper casing 60 primarily disposed on the upper wall 28 of the lockbox body 20. The upper casing 60 has two protruding portions 62 which at least partially surround the shackle apertures 32 and extend vertically upward, away from the remainder of the lockbox body 20. In the depicted embodiment, the protruding projections extend above the curved portions of the shackle 70. The upper casing 60 also includes two upwardly diverging interior surfaces 64 extending from near the upper wall 28 to a point substantially up the protruding projections 62. In the depicted embodiment, the two upwardly diverging interior surfaces 64 do not contact each other and are separated by a casing landing 65. However, it will be appreciated that the two upwardly diverging interior surfaces 64 may contact each other at or near the base of the upper wall such that there is no casing landing 65.

The two upwardly diverging interior surfaces 64 define a V-shaped notch which extends downwardly toward the lockbox body 20, with the upwardly diverging interior surfaces 64 being laterally aligned with the curved portion of the shackle 70 to create a handle receiving area H between the shackle 70 and upper casing 60. As will be discussed below, when the shackle 70 is retained in the lockbox body 20 and the lockbox assembly 10 is secured around a door handle, the casing 60 provides a secure fit around the underside of the door handle without scratching or marring the door hardware. Due to the V-shape, varying sized and shaped door handles may be secured in the handle receiving area H as the longitudinal portions of the door handle may contact the upper casing 60 at varying points on the upwardly diverging interior surfaces 64 and/or casing landing 65. The abutment of the upwardly diverging interior surfaces 64 and the curved portion of the shackle 70 with the neck of the door handle impedes side-to-side twisting rotation of the lock assembly 10 about a vertical axis extending through the curved portion of the shackle 70. This impediment of twisting rotation further holds the lockbox assembly 10 in place and prevents the lockbox 10 from being removed from a lever-set handle.

In an exemplary embodiment, the protruding projections 60 extend from about 0.75 to 1.50 inches above the shackle apertures 32 and are between about 0.5 and 1.0 inch thick. The upwardly diverging interior surfaces 60 extend at an angle between about 25° and 50° and connect with the protruding projections 60 at a point about 0.5 to 0.9 inches above the shackle apertures 32. The casing landing 65 separating the upwardly diverging interior surfaces 64 has a width of between about 0.1 and 0.3 inches and a thickness between of about 0.1 to 0.3 inches above the upper wall 28.

In an exemplary embodiment, the protruding projections 60 extend about 1.16 inches above the shackle apertures 32 and are about 0.75 inches thick. The upwardly diverging interior surfaces 64 extend at about a 38.66° angle and connect with the protruding projections 60 at a point about 0.68 inches above the shackle apertures 32. The casing landing 65 separating the upwardly diverging interior surfaces 64 is about 0.20 inches wide and has a thickness of about 0.19 inches above the upper wall 28.

In an exemplary embodiment, the upper casing 60 is made of plastic and the upper casing 60 and the lower casing 46 are continuous and unitary. Such a configuration may further protect the lockbox body 20 from tampering, prevent moisture or other contaminants from contacting the lockbox body 20, and would increase the aesthetics of the lockbox. Also, the use of plastic for the two casings 46, 60 may prevent the lockbox 10 from scratching, marring, or otherwise damaging door hardware as, when the lockbox assembly 10 is hung from door handle, the door 22 is oriented away from the door and the rear wall 24 may knock against the door hardware, including the door itself. However, it will be appreciated that the protective casing 60 and back panel 46 may be separate pieces and one or both may be another material that provides protection to the lockbox body 20 and does not scratch or mar door hardware, such as rubber, soft metal, or any other material known in the art.

Figure 6A:
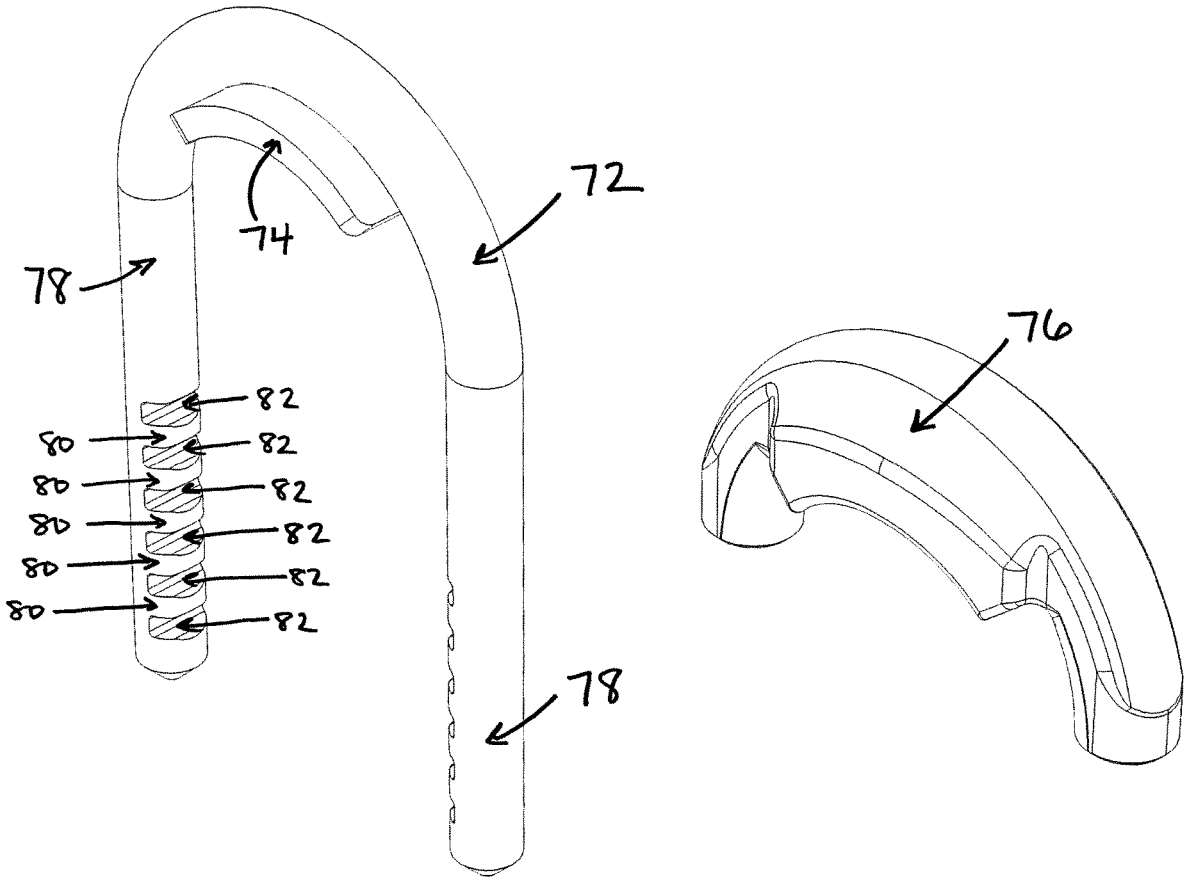
FIG. 6A is a top perspective view of the shackle of the lockbox assembly of FIGS. 1A-1C with the cover removed.
Figure 6B:
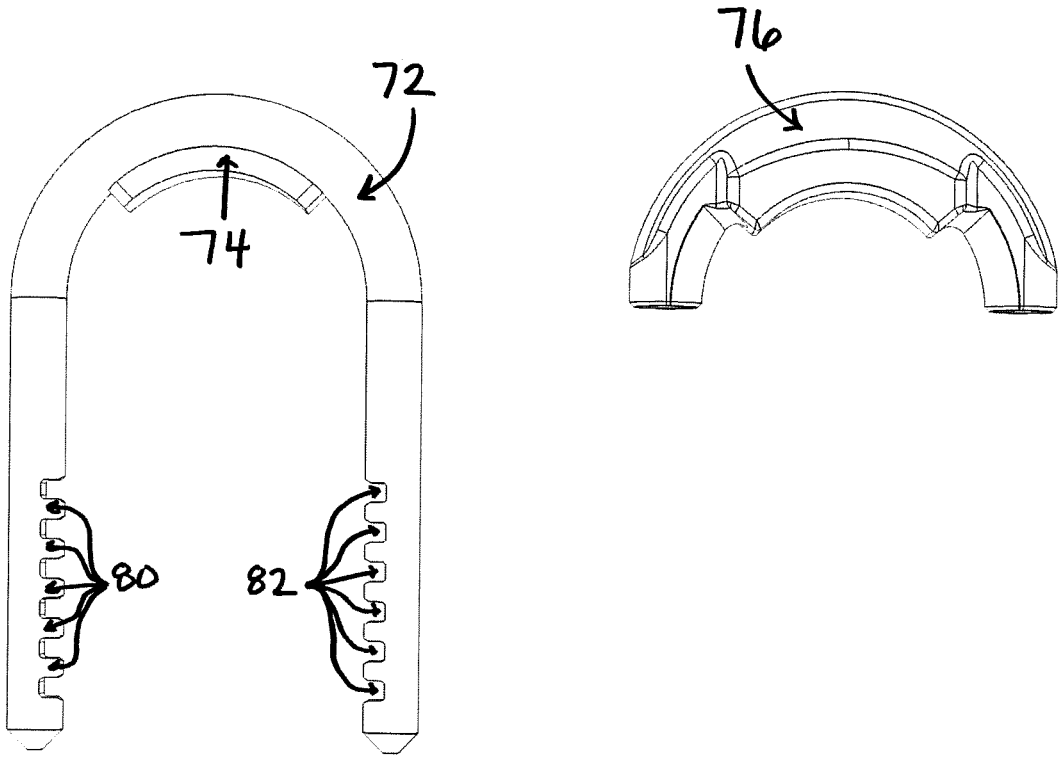
FIG. 6B is a front view of the shackle of the lockbox assembly of FIGS. 1A-1C with the cover removed.
Figure 6C:
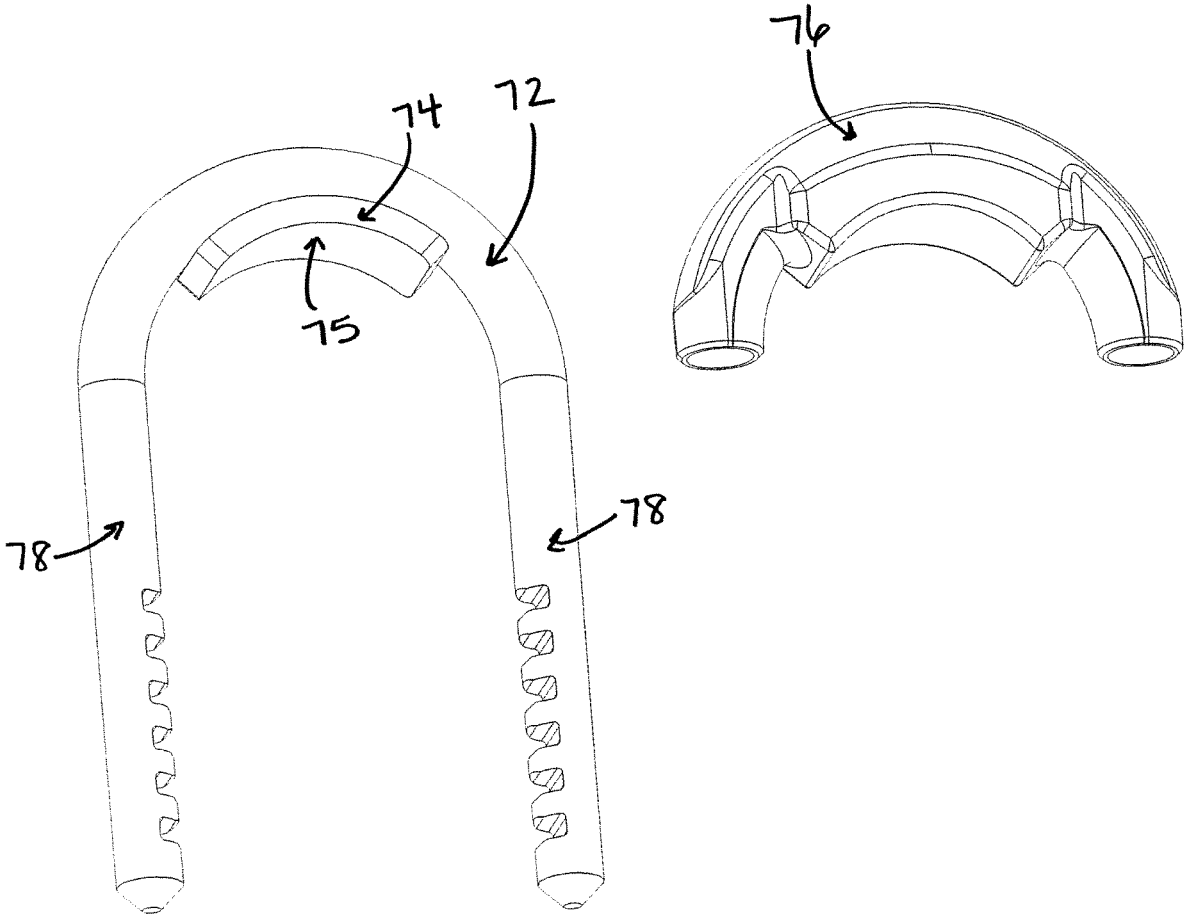
FIG. 6C is a bottom perspective view of the shackle of the lockbox assembly of FIGS. 1A-1C with the cover removed.

Turning to FIGS. 6A-6B, the shackle 70 has a shackle member 72, a guard wall 74, and a cover 76. The shackle 70 is couplable with the lockbox body 20 and is shaped such that it may be placed around various sized door handles. In use, as will be explained below, the shackle 70 is detachable from the lockbox body 20 so that the shackle 70 may be placed around a door handle and then connected to the lockbox body 20 to secure the lockbox 10 to the door handle.

The shackle member 72 is generally U-shaped with a curved portion and two substantially straight portions. In an exemplary embodiment, the shackle member 72 is a curved metal rod. The two substantially straight portions of the shackle member 72 define two shackle legs 78 which are substantially the same size and substantially symmetrical over a line extending perpendicularly from the apex of the U-shaped portion of the shackle member 72. The shackle legs 78 are sized and shaped to fit within the shackle bores 34 in the retaining body 42. In the depicted embodiment, the shackle legs 78 come to a truncated conical shape at the distal-most portion of the legs 78 to fit into the shackle apertures 32 and shackle bores 34 more easily.

The shackle legs 78 include teeth 80 laterally disposed on the inside portions of the shackle legs 78. The teeth 80 are generally rectangular and disposed at regular intervals along the shackle legs 78, defining a plurality of notches or latch points 82 between the successive teeth 80 on the inside portions of the shackle legs 78 which are sized and shaped to receive a distal portion of the latch member 57. The shackle legs 78 are sized and shaped to be received and operatively secured in the shackle bores 34 of the retaining body 20. The shackle legs 78 and teeth 80 are sized and shaped to fit through the shackle apertures 32 and shackles bores 34 and strong enough to retain the shackle 70 secured with the lockbox body 20 when force is applied to either the lockbox body 20 or the shackle 70.

In a preferred embodiment, the shackle 70 may be securely retained in the lockbox body 20 at a plurality of latched positions such that the lockbox assembly 10 may be secured on door handles or similar objects of varying shapes and sizes. As will be discussed below, the shackle 70 may be secured in the shackle bores 34 at each latch point 82 by the latch member 57 such that each latch point 82 corresponds to a separate locking position of the shackle 70 within the lockbox body 20. As the latch points 82 are disposed vertically along the shackle legs 78, the plurality of latched positions permit the shackle 70 to be secured in the lockbox body 20 at a plurality of vertical displacements, allowing a user to adjust a distance between the upper wall 28 of the lock body 20 and the interior arcuate wall surface 75. Such adjustment allows the lockbox assembly 10 to be secured around door handles of varying size and shape.

The guard wall 74 is generally a flat, curved piece attached to the shackle member 72 along the underside of the curved portion of the shackle member 72. The guard wall 74 defines an interior arcuate wall surface 75 oriented away from the curved portion of the shackle member 72 and extending forward and rearward from a central plane bisecting the shackle 70. As will be described below, when the lockbox assembly 10 is secured on a door handle, the guard wall 74 increases the surface engagement of the shackle 70 with the neck of the door handle along the longitudinal portion of the handle and secures the lockbox assembly 10 to the handle, making it more difficult to forcibly remove the lockbox assembly 10. The interior arcuate wall surface 75 of the guard wall 74 provides greater contact with the door handle to prevent a device, such as a crowbar, from being placed between the door handle and the shackle 70 to break the lockbox 10 off the door. Also, the increased contact or abutment along the length of the door handle between the interior arcuate wall surface 75 and the radial portions of the neck of the door handle impedes forward and rearward rotation of the lock assembly 10 about a horizontal axis extending through the curved portion of the shackle 70. In an exemplary embodiment, the guard wall 74 is metal and is welded to the underside of the shackle member 72.

The cover 76 substantially surrounds the guard wall 74 and the curved portion of the shackle member 72. In an exemplary embodiment, the cover 76 completely encases the guard wall 74 and substantially all the shackle member 72 which would be exposed when the shackle 70 is in the tightest locking position. In the exemplary embodiment, the cover 76 does not extend to encompass the shackle legs 78. In other embodiments, however, the cover may partially or completely encompass the shackle legs 78. The cover 76, as will be explained below, provides a snug fit of the shackle 70 against a door handle and prevents marring and scratching of the door handle. In an exemplary embodiment, the cover 76 is plastic and is molded over the shackle member 72 and guard wall 74.

While the shackle 70 has been described with a U-shaped shackle member 72, a welded metal guard wall 74, and a plastic mold-over cover 76, it will be appreciated that other designs are contemplated. For example, the shackle member 72 may be of a design other than a U-shape, such as square, rectangular, more circular, or any other shape known in the art. Also, the cover 76 may be another material, such as rubber, a soft metal, or any other material known in the art. Additionally or alternatively, the guard wall 74 may be substantially straight, flared at the edges, or any other shape known in the art.

Turning back to FIGS. 4A-4B, as discussed above, the release button 56 is disposed on the retaining body 42 within the body 20. When the door 22 is attached to the rest of the lockbox body 20, the release button 56 is encased within the body 20 and is inaccessible to a user, but is exposed when the door 22 is removed. Once a user has removed the door 22 (e.g., entered the proper combination on the combination dials 50 and released the open lever 52), the user may press the release button 56 to move or adjust the shackle 70 within the shackle bores 34, and the user may release the release button 56 to secure the shackle 70 in the shackle bores 34 at one of a plurality of latched positions.

Once the door 22 has been removed, a user may press the release button 56 to remove the latch member 57 from a locking position within the shackle 70 or may release the release button 56 to move the latch member 57 into a position which locks the shackle 70 in the shackle bores 34. When the release button 56 is in the un-pressed or released stated, the latch member 57 is laterally biased by the latch member spring 59 and partially extends into the shackle bores 34 between the teeth 80 of the shackle 70 and into one of the latch points 82 to block the vertical movement of the teeth 80 defining the particular latch point 82, thus preventing vertical movement of the shackle 70. The butting engagement between the latch member 57 and the shackle teeth 80 prevent the shackle 70 from being tightened, loosened, or removed. When the release button 56 is pressed, held, or otherwise activated, the biasing force of the latch member spring 59 is removed and the latch member 57 is retracted from the latch point 82 and recedes from the shackle bores 34. Once the latch member is retracted, the shackle legs 78 are free to be moved in the shackle bores 34, either up or down, or may be removed from the shackle bores 34 entirely to disconnect the shackle 70 from the lockbox body 20.

Figure 7A:
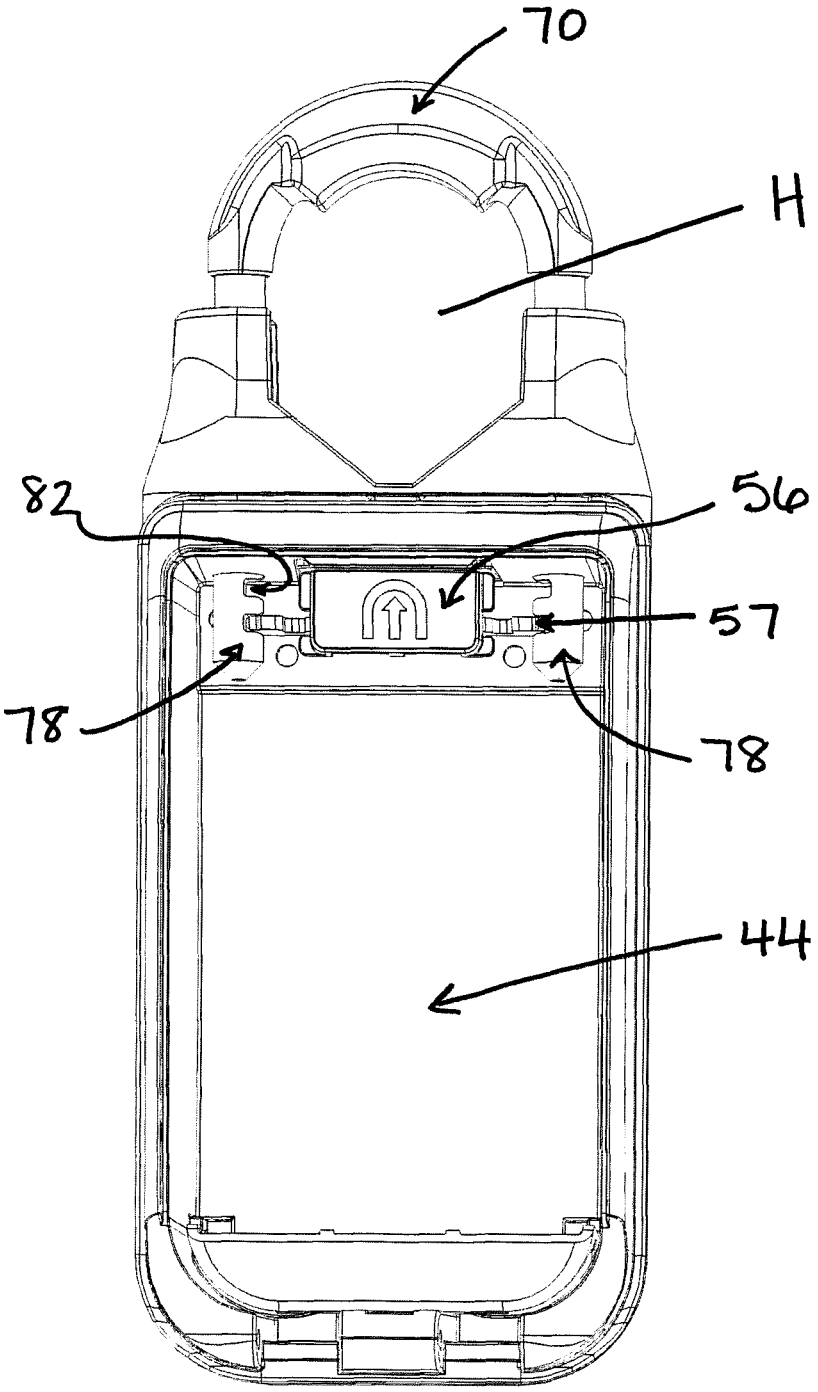
FIGS. 7A-7F are front views depicting the lockbox assembly of FIGS. 1A-1C with the shackle locked at varying latched positions in the interior of the lockbox body, with the door, weather cover, and retaining body enclosure removed to illustrate additional features of the lockbox assembly.
Figure 7B:
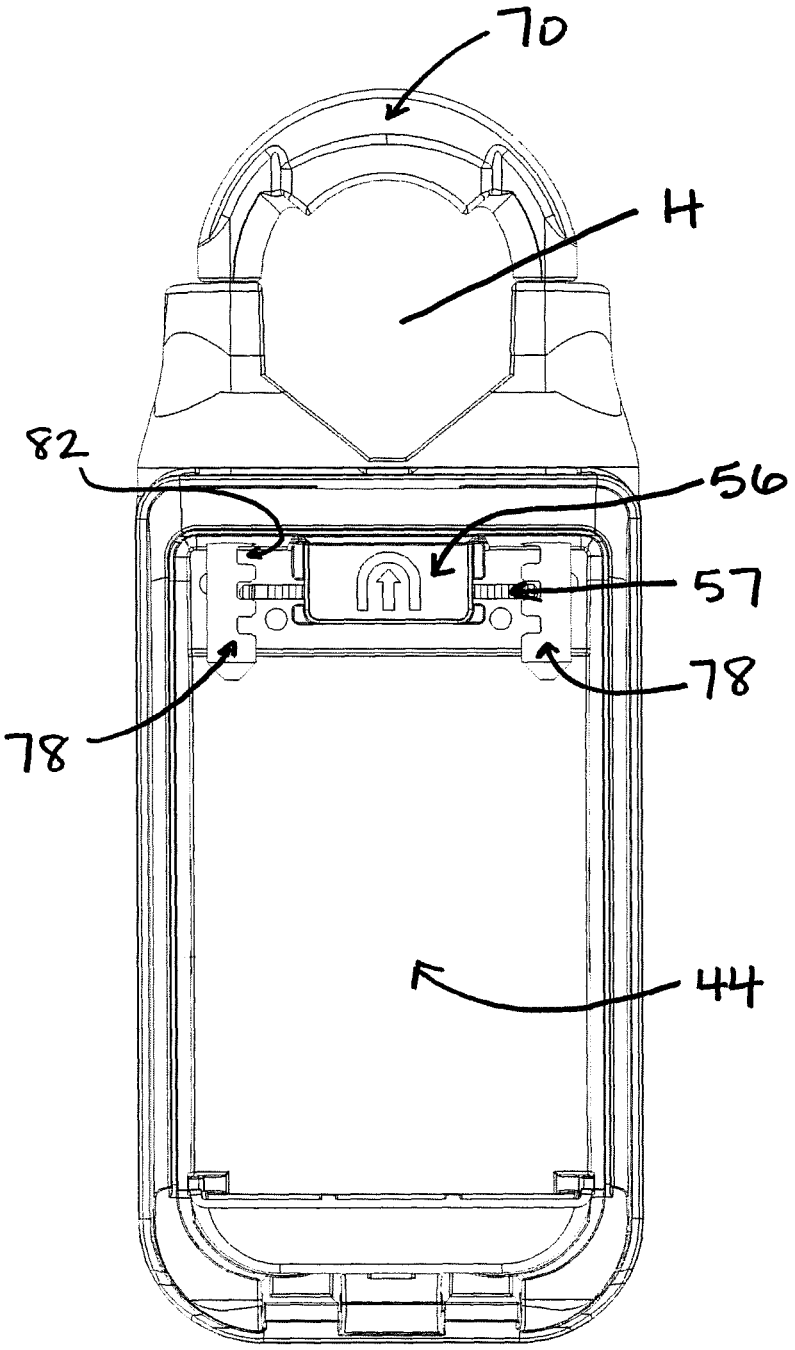
Figure 7C:
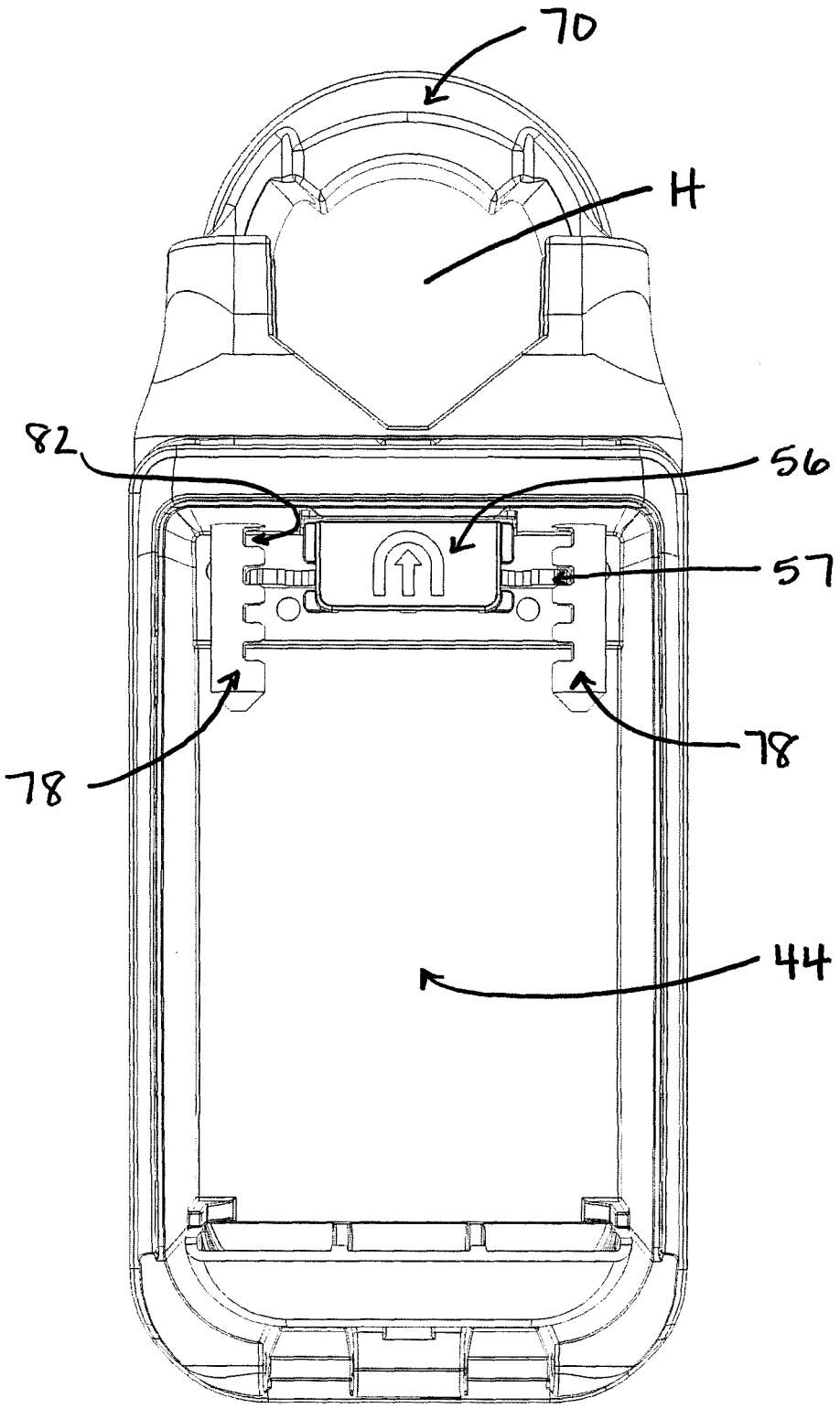
Figure 7D:
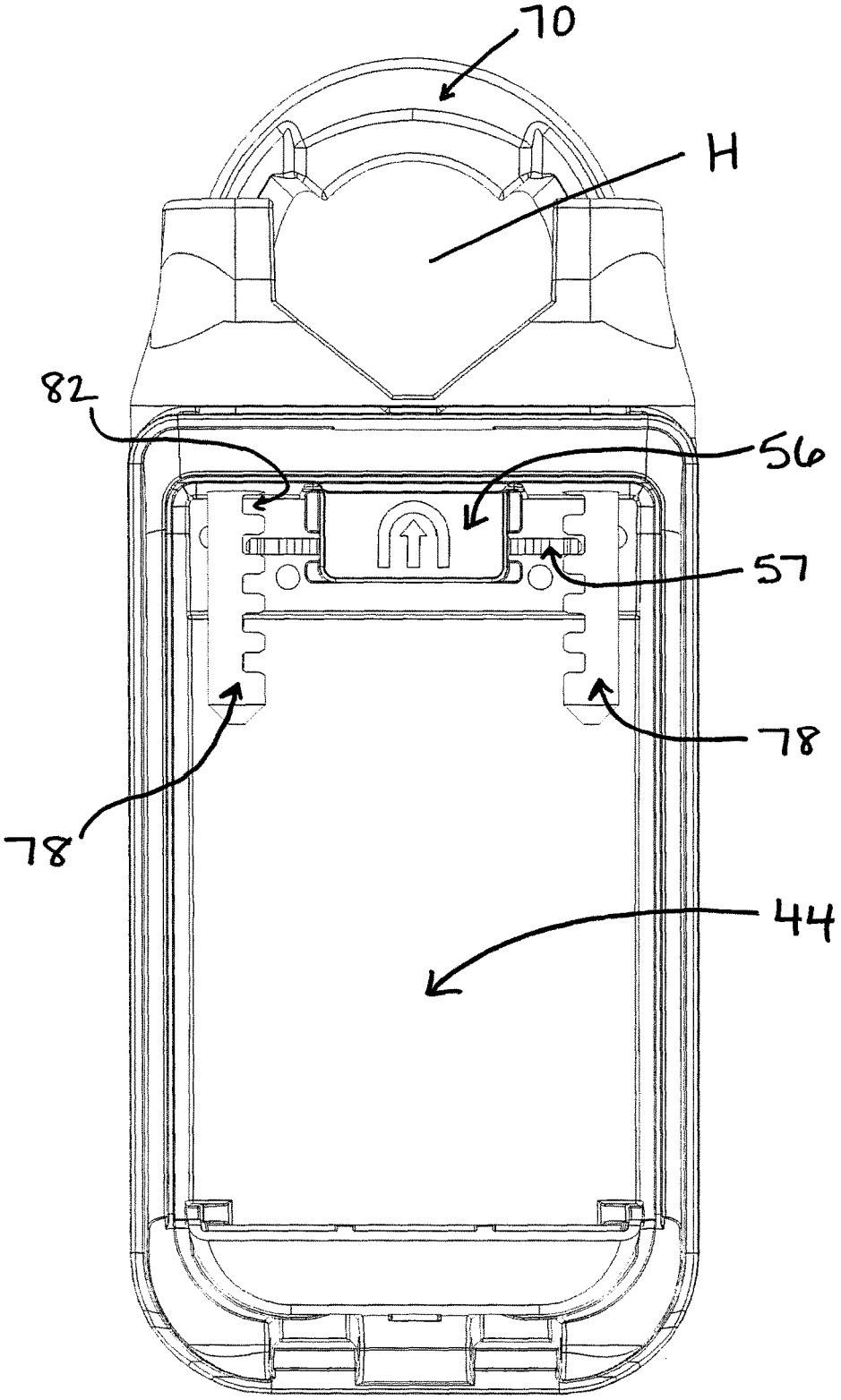
Figure 7E:
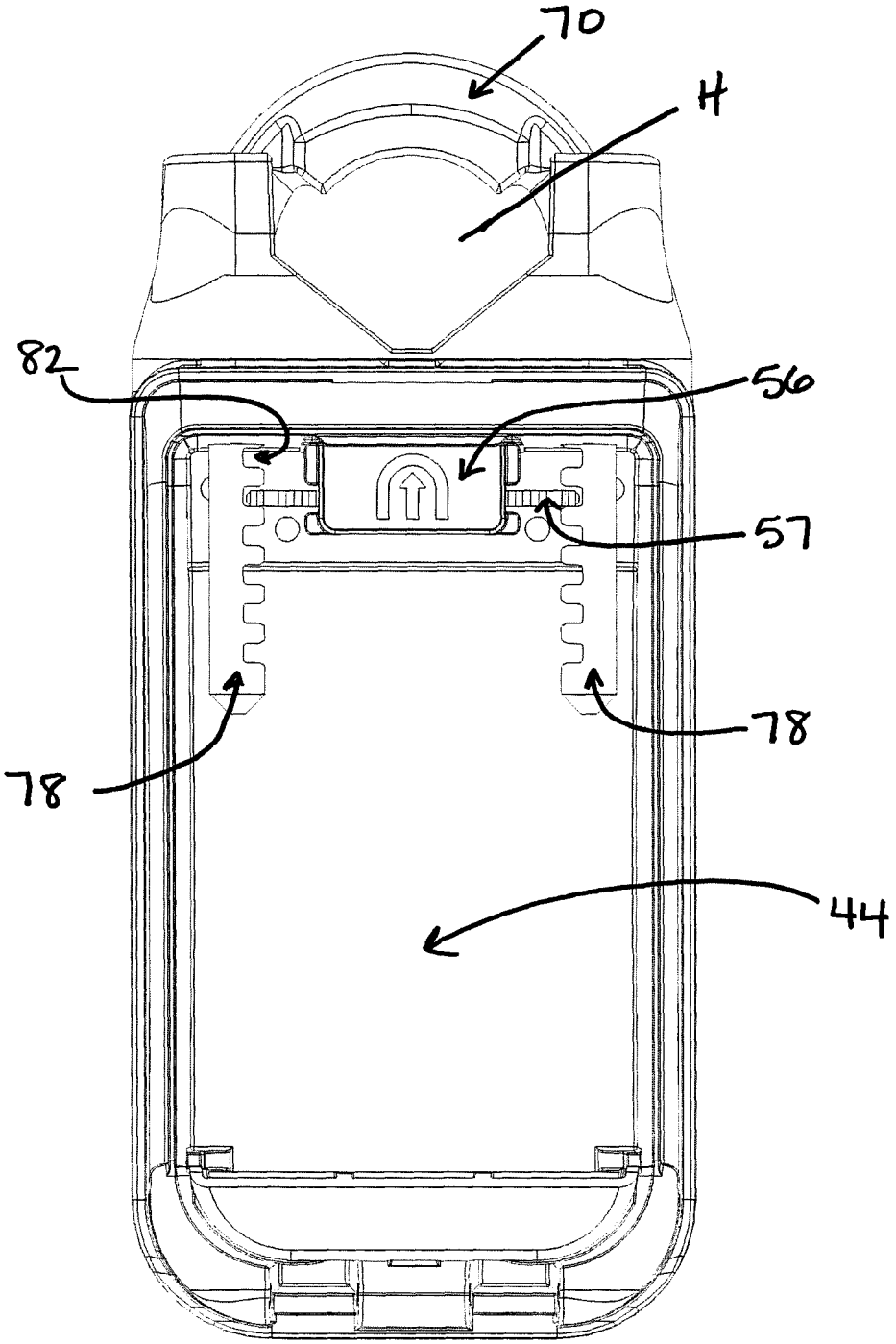
Figure 7F:
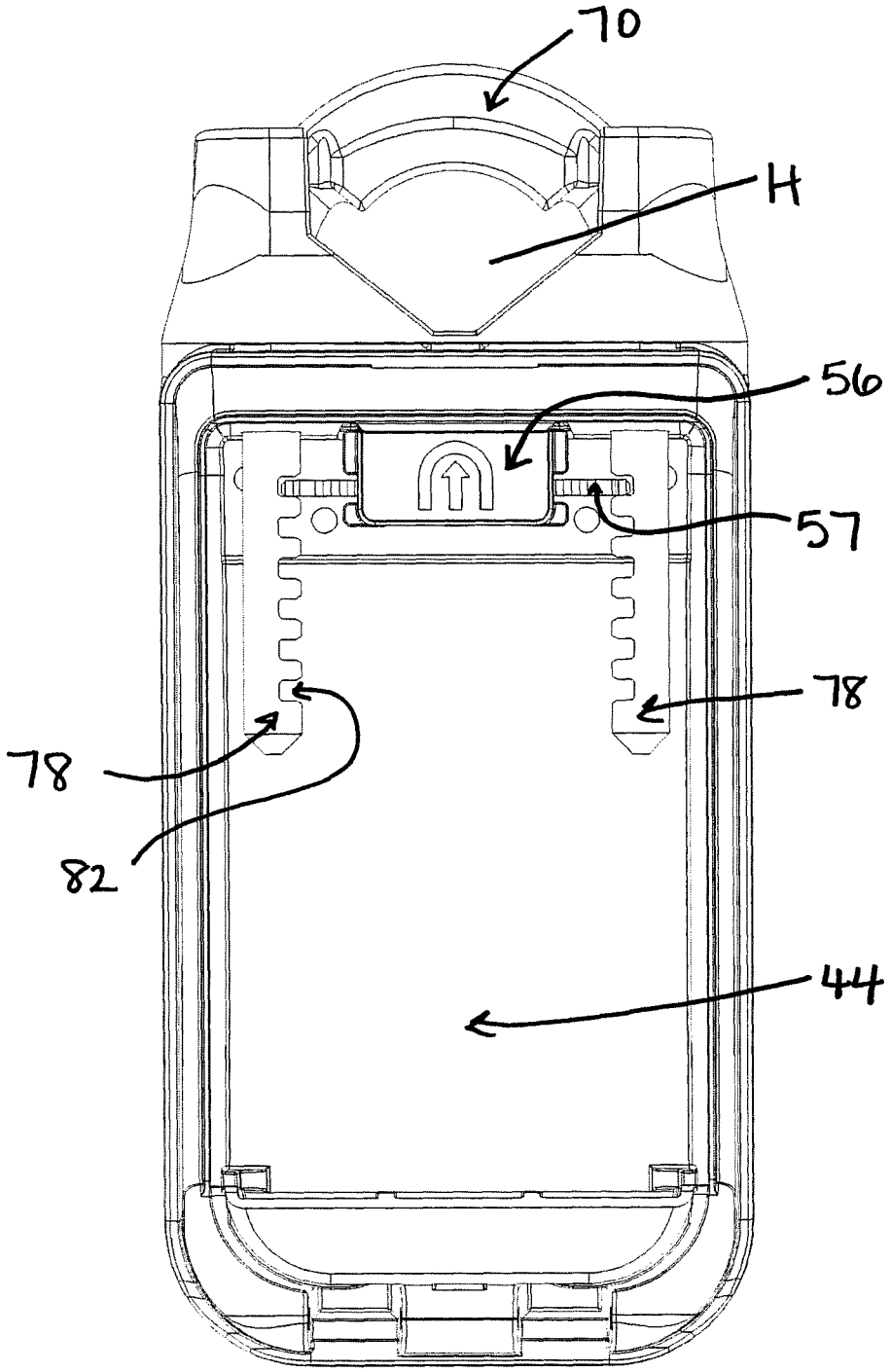

As shown in FIGS. 7A-7F, the shackle 70 may be secured by the latch member 57 at a plurality of latched positions within the lockbox body 20. FIG. 7A depicts the shackle 70 secured by the latch member 57 at the first latch point 82 defining a first latched position and thereby effectuating the largest handle receiving area H. FIG. 7F depicts the shackle 70 secured by the latch member 57 at the sixth latch point 82 defining a sixth lock position and thereby effectuating the smallest or tightest handle receiving area H. FIGS. 7B through 7E depict the shackle 70 secured by the latch member 57 at second through fifth latched positions, respectively, to define handle receiving areas H of varying selectable sizes. Permitting the shackle 70 to be securable in the lockbox body 20 at a plurality of latch points 82 thereby defining a plurality of latched positions allows the lockbox assembly 10 to be secured around door handles of varying sizes and geometries. While the figures depict a shackle that is lockable in six latched positions based on the six latch points 82, it will be appreciated that the shackle 70 may have more or fewer latch points 82 and thereby have more or fewer latched or latching positions.

Figure 9A:
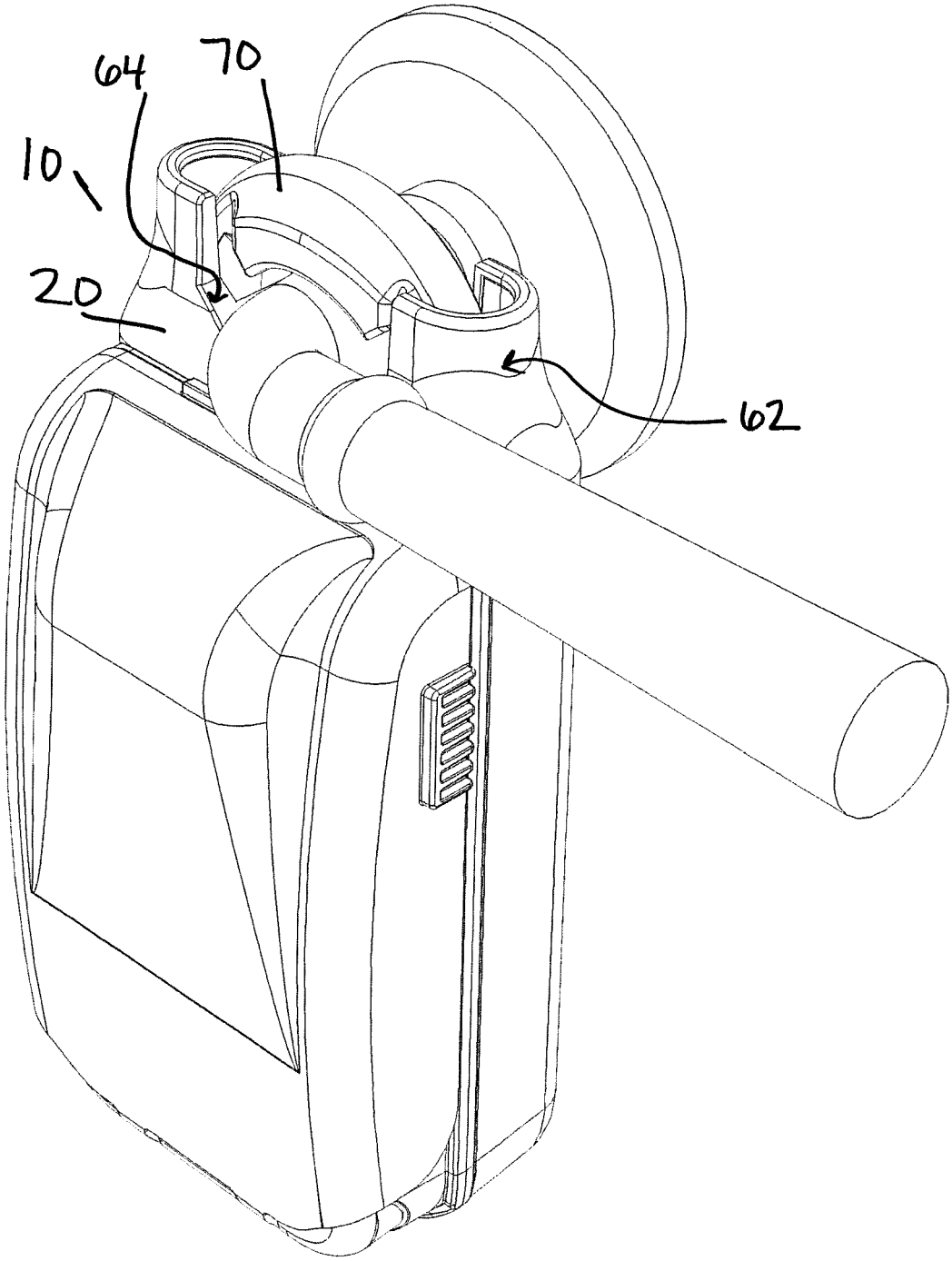
FIGS. 9A and 9B are perspective views of the lockbox assembly of FIGS. 1A-1C secured on a lever-set door handle.
Figure 9B:
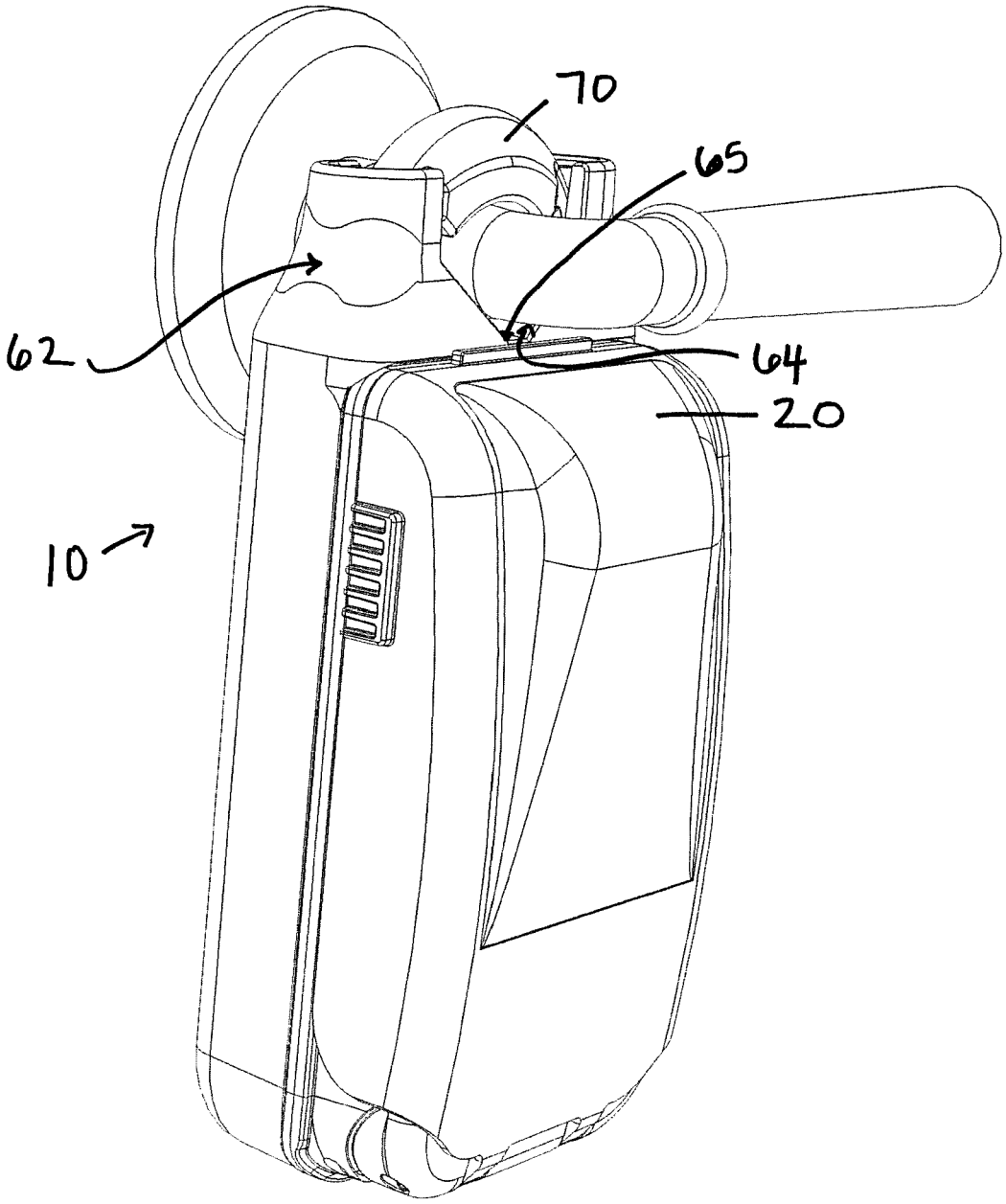
Figure 10A:
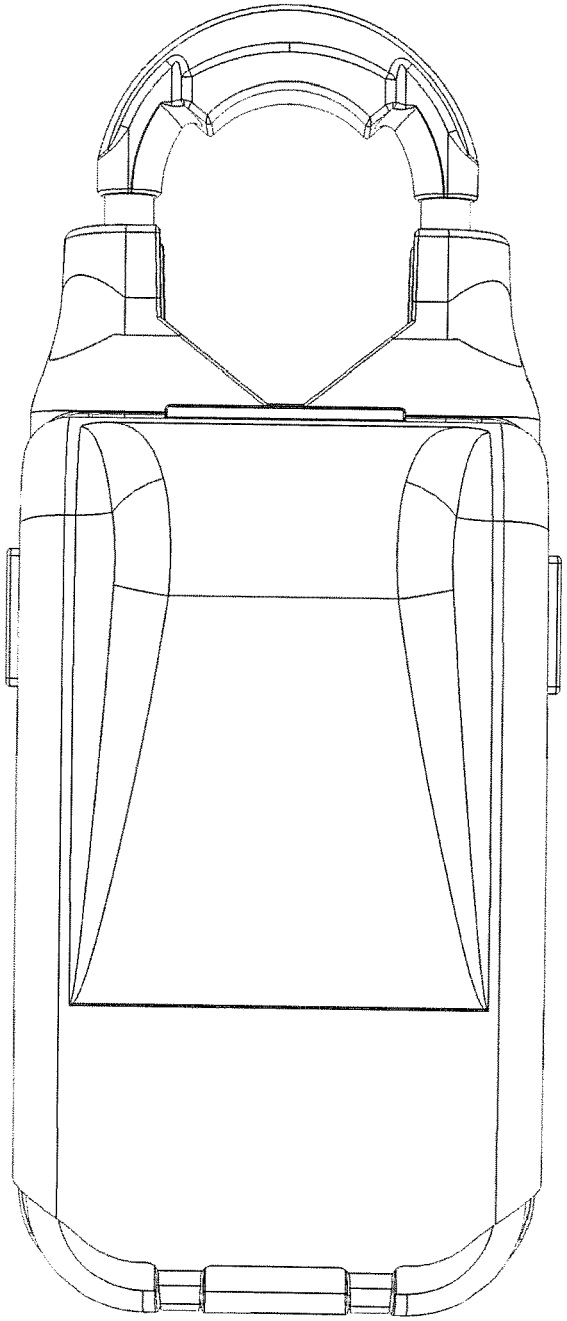
FIGS. 10A-10H are front, rear, left side, right side, top, bottom, upper perspective, and lower perspective views of the lockbox assembly of FIGS. 1A-1C.
Figure 10B:
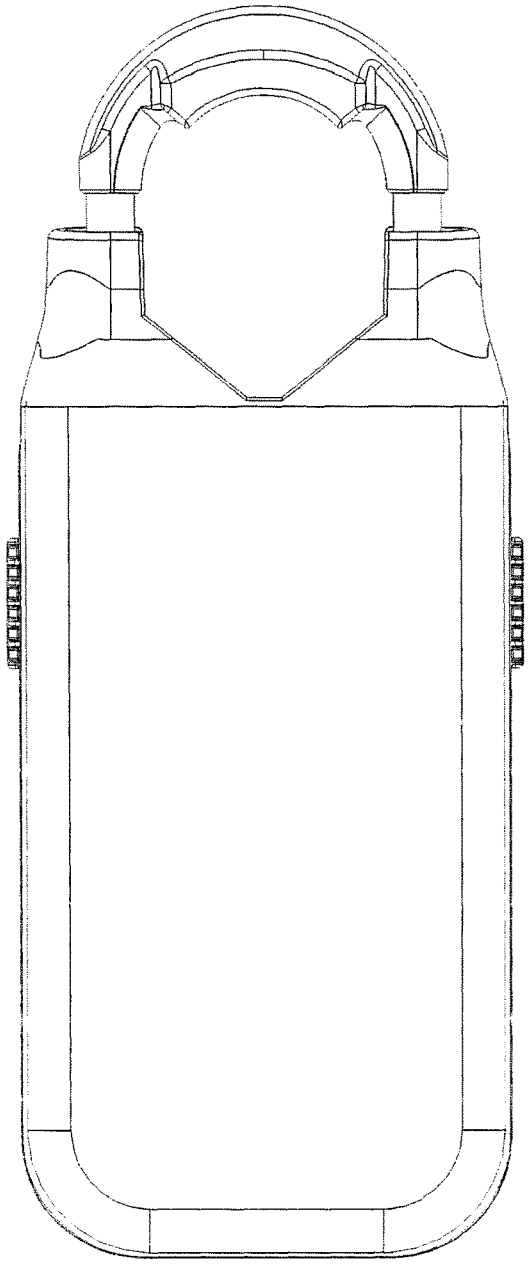
Figure 10C:
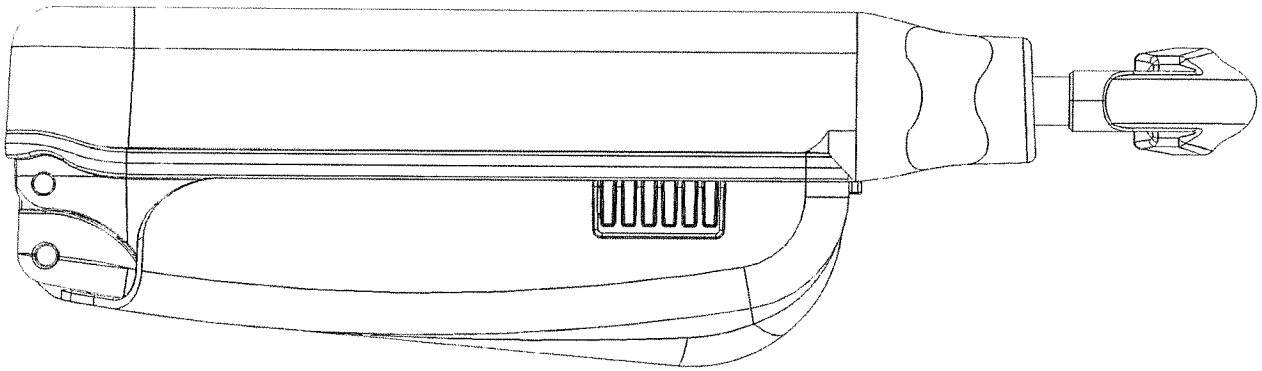
Figure 10D:
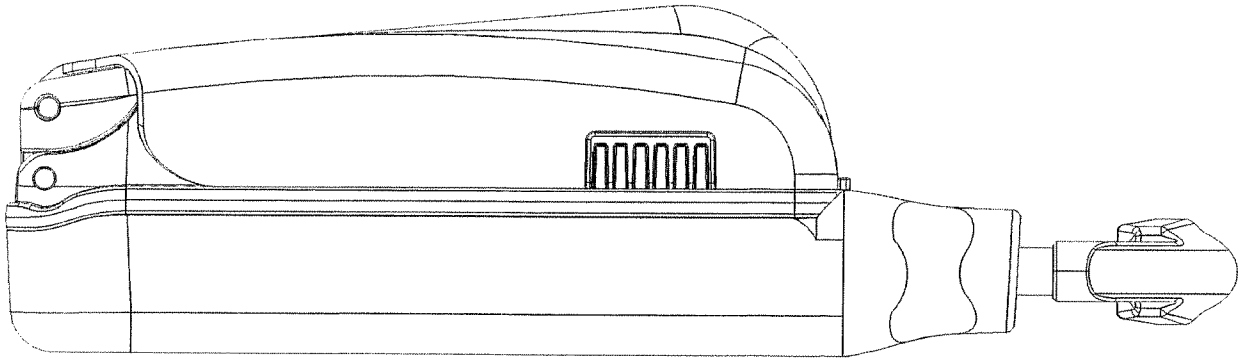
Figure 10E:
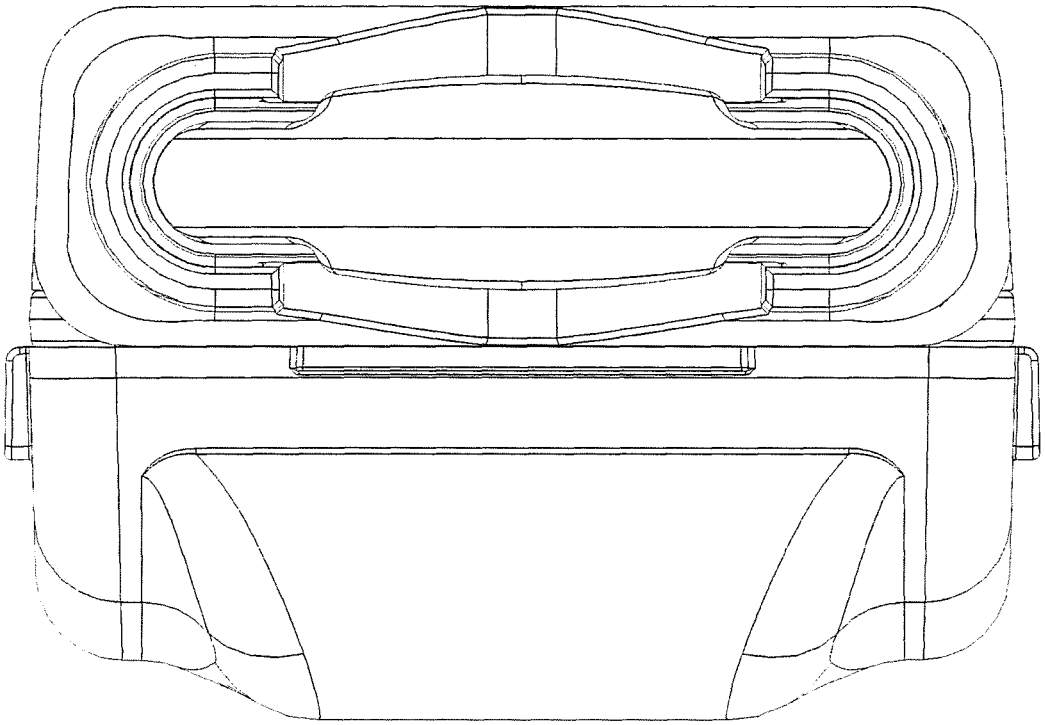
Figure 10F:
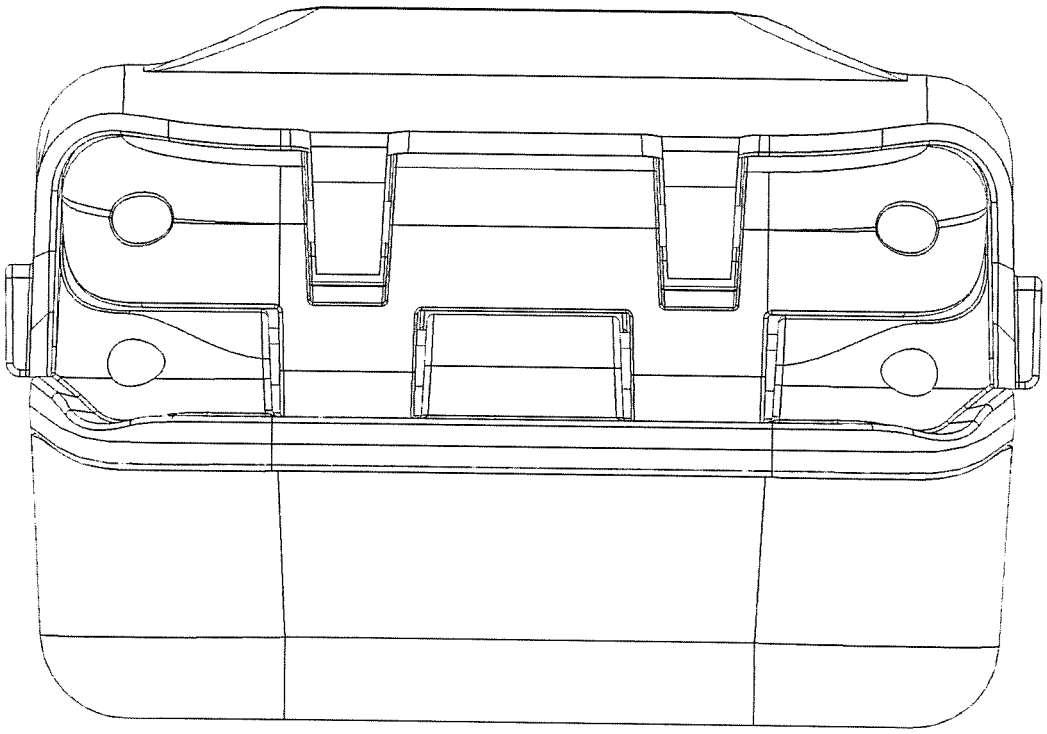
Figure 10G:
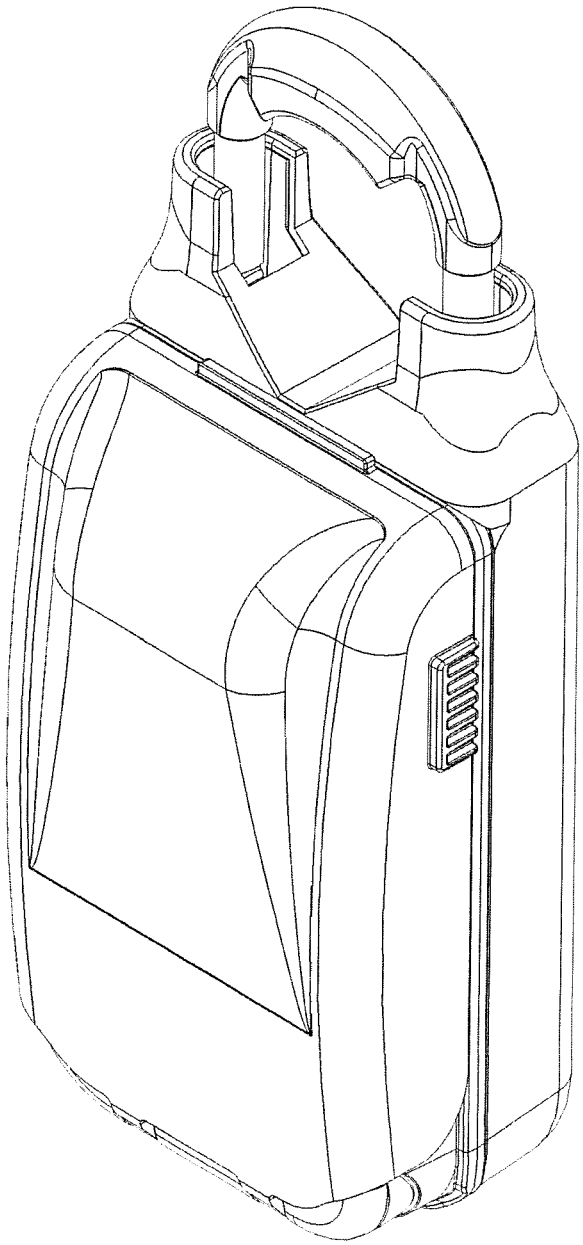
Figure 10H:
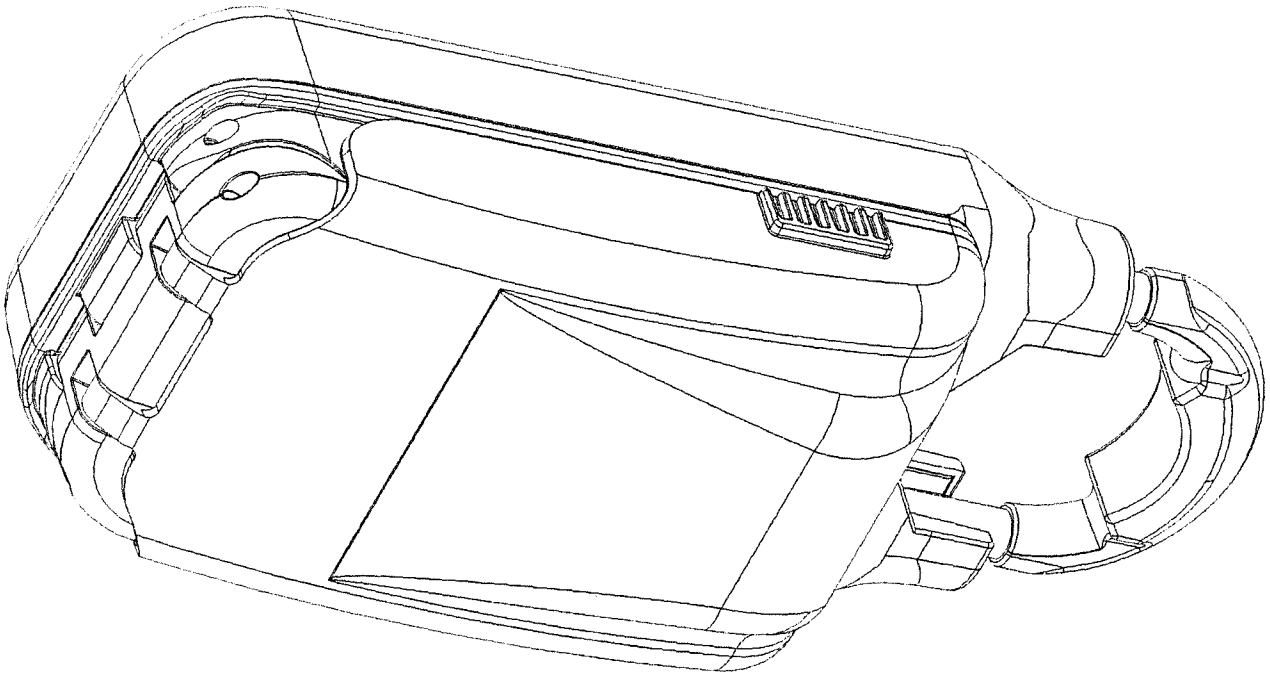

As shown in FIGS. 9A and 9B, the lockbox 10 may be hung on a door handle and secured. As described above, a user may open the door 22, press the release button 56 to remove the latch member 57 from the latch points 82, and may then completely remove the shackle 70 from the lockbox body 20. Once removed, the user may then place the shackle 70 around the door handle such that the interior arcuate wall surface 75 is in contact with the upper radial portion of the neck of the door handle. The user may then reconnect the shackle 70 to the lockbox body 20 by inserting the shackle legs 78 into the shackle bores 34 such that the door handle is in the handle receiving area H. While the shackle legs 78 are in the shackle bores 34 and while the user presses the release button 56, the user may move the lockbox body 20 upward along the shackle legs 78 until the upwardly diverging interior surfaces 64 and/or casing landing 65 are in snug contact with lower radial portions of the neck of the door handle. The user may then release the release button 56 to cause the latch member 57 to move into engagement with the teeth 80 of the shackle legs 78 and thereby secure the shackle 70 in the lockbox body 20.

As described above, in an exemplary embodiment, when the lockbox assembly 10 is snugly secured on a door handle, the interior arcuate wall surface 75 of the guard wall 74 (or the portion of the cover 76 surrounding the interior arcuate wall surface 75), the upwardly diverging interior surfaces 64, and/or the casing landing 65 will abut radial portions of the door handle along the length of the neck of the door handle. The abutment between the interior arcuate wall surface 75 of the guard wall 74 (or the portion of the cover 76 surrounding the interior arcuate wall surface 75) and the top portion of the door handle and/or the abutment between the casing landing 65 and the bottom portion of door handle impedes forward and rearward rotation of the lock assembly 10 about a horizontal axis extending through the curved portion of the shackle 70. Additionally, the abutment between the upwardly diverging interior surfaces 64 and the left and right portions of the door handle impedes side-do-side twisting rotation of the lock assembly 10 about a vertical axis extending through the curved portion of the shackle 70. The prevention of both types of twisting or rotation maintain the lockbox assembly 10 securely on a door handle. For example, the impediment to side-to-side twisting rotation (if the lockbox is in a vertical position relative to the door handle) and impediment to forward and rearward rotation about a horizontal axis extending through a curved portion of the shackle 70 (if the lockbox is in a horizontal position after being rotated about an axis extending through the neck of the door handle), prevent the lockbox assembly from being maneuvered and subsequently removed from a door handle in which the door handle is not substantially larger in diameter than the neck, such as a lever-set handle.

A user may also tighten or loosen the shackle 70 and lockbox body 20 to secure the lockbox on varying sized door hardware by the same method. While the shackle 70 is in place on the door hardware and the door 22 of the lockbox is removed, thereby exposing the release button 56, the user may hold down the release button 56 and push up or down on lockbox body 20 until the shackle 70 and lockbox body 20 are in a desired position. When the shackle 70 and lockbox body 20 are in the desired position, the user may release the release button 56 to re-engage the latch members in the lockbox body 20 against the shackle teeth 80 and thereby secure the shackle 70 and lockbox body 20 on the door hardware.

Once the lockbox assembly 10 has been secured in the desired position around a door handle or similar object, a user may further secure the lockbox assembly. Once the shackle 70 has been locked in the body 20 and the release button 56 has been disengaged, the user may close the door 22 and set the interface to the locking position (e.g., by scrambling the combination entered on the combination dials 50) to lock the door 22 and prevent access to the interior of the body 20. Optionally, the user may then also move the weather cover 40 into the position covering the door 22 to further secure the lockbox assembly 10 from unwanted tampering or manipulation.

One of ordinary skill in the art will now appreciate that the present invention provides a lockbox assembly that maintains a shackle in one of a plurality of locking positions around various sized door handles and within a lockbox body. Although the present invention has been shown and described with reference to particular embodiments, equivalent alterations and modifications will occur to those skilled in the art upon reading and understanding this specification. The present invention includes all such equivalent alterations and modifications.

What is claimed is:

1. A lock assembly comprising:

a lock body; and a U-shaped shackle having a curved portion extending between first and second legs receivable in first and second shackle apertures in an upper surface of the lock body, and a guard wall affixed to an interior surface of the curved portion, the guard wall defining an interior arcuate wall surface extending forward and rearward from a central plane bisecting the first and second legs of the shackle and beyond frontmost and rearmost surfaces of the shackle;

wherein the lock body includes a latching mechanism configured to secure the shackle in a plurality of latched positions to adjust a distance between the upper surface of the lock body and the interior arcuate wall surface;

wherein when the shackle is secured around a door handle with the shackle secured in a suitable one of the plurality of latched positions, abutment of the interior arcuate wall surface with a neck portion of the door handle impedes forward and rearward rotation of the lock assembly about a horizontal axis extending through the curved portion of the shackle.

2. The lock assembly of claim 1 wherein the shackle member and guard wall comprise metal.

3. The lock assembly of claim 1 wherein the shackle further comprises a cover which encompasses the guard wall and the curved portion of the shackle member.

4. The lock assembly of claim 3 wherein the cover comprises a molded-over plastic member.

5. The lock assembly of claim 3 wherein the cover encompasses at least a portion of the shackle legs.

6. The lock assembly of claim 1 wherein the lock body comprises an upper casing disposed on an upper wall of the lock body and defining first and second projections partially surrounding the first and second shackle apertures and defining a notch between the first and second protruding projections.

7. The lock assembly of claim 1 wherein the shackle legs include a plurality of notches positioned to define the plurality of latched positions of the shackle.

8. The lock assembly of claim 1, wherein the upper portion of the lock body includes first and second protruding projections at least partially surrounding the first and second shackle apertures and defining first and second upwardly diverging interior surfaces laterally aligned with the curved portion of the shackle, and wherein when the shackle is secured around a door handle with the shackle secured in a suitable one of the plurality of latched positions, abutment of the first and second upwardly diverging interior surfaces with a neck portion of the door handle impedes side-to-side twisting rotation of the lock assembly about a vertical axis extending through the curved portion of the shackle.

9. The lock assembly of claim 8 wherein the first and second upwardly diverging interior faces are separated by a landing.

10. The lock assembly of claim 8 wherein the first and second upwardly diverging interior faces define a V-shape.

11. The lock assembly of claim 8 wherein the lock body includes an upper casing comprising plastic at least partially surrounding the upper portion of the lock body.

12. The lock assembly of claim 11 wherein the lock body includes a back casing disposed on a rear wall of the lock body.

13. The assembly of claim 12 wherein the upper casing and back casing are unitary.

14. A lockbox assembly comprising:

a lockbox body defining an interior cavity for storing an item;

a door lockingly secured with the lockbox body to block access to the interior cavity;

a U-shaped shackle having a curved portion extending between first and second legs receivable in first and second shackle apertures in an upper portion of the lockbox body;

a latching mechanism disposed in the lockbox body and configured to secure the shackle in a plurality of latched positions to adjust a distance between the upper portion of the lockbox and the curved portion of the shackle;

wherein the latching mechanism includes a latch member spring biased into interlocking engagement with an aligned one of a plurality of latch points on at least one of the first and second shackle legs, and a release button disposed in the interior cavity and depressible to disengage the latch member from the aligned one of the plurality of latch points for adjustment of the shackle to a selected position aligning another one of the plurality of latch points with the latch member.

15. The lockbox assembly of claim 14 wherein the lockbox assembly comprises an upper casing disposed on an upper wall of the lockbox body and defining first and second protruding projections extending vertically and at least partially surrounding the first and second shackle apertures.

16. The lockbox assembly of claim 14 wherein the shackle member comprises an upper casing disposed on an upper wall of the lockbox body and having first and second upwardly diverging interior surfaces defining a V-shaped notch.

17. The lockbox assembly of claim 14 wherein the shackle member further comprises a guard wall disposed on an underside of the curved portion of the shackle member and defining an interior arcuate wall surface extending forward and rearward from a central plane bisecting the shackle.

18. The lockbox assembly of claim 14 wherein the shackle further comprises a cover encasing at least the curved portion of the shackle member.

19. The lockbox assembly of claim 14, wherein the door, when lockingly secured with the lockbox body, blocks user access to the release button.

* * * * *